US009856058B1

(12) United States Patent
Arthurs et al.

(10) Patent No.: US 9,856,058 B1
(45) Date of Patent: Jan. 2, 2018

(54) LATCH AND RELEASE MECHANISMS FOR WASTE CONTAINERS

(71) Applicant: The Eastern Company, Cleveland, OH (US)

(72) Inventors: Scott Arthurs, Brunswick, OH (US); Lee S. Weinerman, Medina, OH (US)

(73) Assignee: THE EASTERN COMPANY, Cleveland, OH (US)

( * ) Notice: Subject to any disclaimer, the term of this patent is extended or adjusted under 35 U.S.C. 154(b) by 342 days.

(21) Appl. No.: 14/695,601

(22) Filed: Apr. 24, 2015

Related U.S. Application Data

(60) Provisional application No. 61/984,428, filed on Apr. 25, 2014, provisional application No. 61/984,464, filed on Apr. 25, 2014, provisional application No. 62/081,365, filed on Nov. 18, 2014.

(51) Int. Cl.
*E05C 3/06* (2006.01)
*B65D 45/02* (2006.01)
*B65F 1/16* (2006.01)

(52) U.S. Cl.
CPC ..... *B65D 45/02* (2013.01); *B65F 1/16* (2013.01); *B65F 2001/1653* (2013.01)

(58) Field of Classification Search
CPC .. B65F 1/1615; B65F 1/16; B65F 2001/1669; B65F 2210/148; E05B 15/0093; E05B 65/5292; Y10T 292/1063; Y10T 292/0937; Y10S 220/908
USPC ..... 292/195, 230, 182
See application file for complete search history.

(56) References Cited

U.S. PATENT DOCUMENTS

| | | | | |
|---|---|---|---|---|
| 5,224,744 | A * | 7/1993 | Michelutti | B65F 1/1615 220/908 |
| 5,599,050 | A * | 2/1997 | Tinsley | B65F 1/1615 220/908 |
| 6,290,093 | B1 * | 9/2001 | Obriot | B65F 1/1615 220/324 |
| 6,666,485 | B1 * | 12/2003 | Moret | B65F 1/1615 220/315 |
| 7,540,393 | B2 * | 6/2009 | Wong | B65F 1/02 220/324 |
| 9,580,243 | B2 * | 2/2017 | Reeb | B65F 1/1646 |
| 9,580,244 | B2 * | 2/2017 | Reeb | B65F 1/1615 |
| 9,682,819 | B2 * | 6/2017 | Reeb | B65F 1/1615 |
| 2007/0090114 | A1 * | 4/2007 | Rouns | B65F 1/1615 220/326 |
| 2015/0053684 | A1 * | 2/2015 | Nussbaum | E05B 15/0093 220/324 |

(Continued)

*Primary Examiner* — Mark Williams
(74) *Attorney, Agent, or Firm* — Ralph E. Jocke; Walker & Jocke

(57) ABSTRACT

A latch is usable to latch and automatically unlatch a lid of a waste container. The latch includes a release weight that moves responsive to gravity in a housing from a first position to a second position to cause the latch to disengage from a release receptacle when the latch and the waste container are oriented in a dump angle orientation. The latch includes a rotary damper in the housing that controls movement of the release weight in the housing such that an amount of time for the release weight to move responsive to gravity from the first position to the second position is slower than the amount of time the release weight would move responsive to gravity from the first position to the second position in the housing absent the effect of the rotary damper on the release weight.

25 Claims, 18 Drawing Sheets

(56) References Cited

U.S. PATENT DOCUMENTS

| | | | | |
|---|---|---|---|---|
| 2015/0308161 | A1* | 10/2015 | Rosales | E05B 85/26<br>292/195 |
| 2016/0200509 | A1* | 7/2016 | Matuschek | E05C 3/124<br>292/242 |

* cited by examiner

LATCH AND RELEASE MECHANISMS FOR WASTE CONTAINERS

CROSS REFERENCE TO RELATED APPLICATIONS

This application claims benefit pursuant to 35 U.S.C. §119(e) of Provisional Application Nos. 61/984,428 filed Apr. 25, 2014, 61/984,464 filed Apr. 25, 2014 and 62/081,365 filed Nov. 18, 2014, the disclosures of each of which are incorporated herein by reference in its entirety.

TECHNICAL FIELD

Exemplary embodiments relate to mechanical latches that selectively hold items in engagement and release such items from engagement. Exemplary embodiments further relate to latches used to selectively hold and release lids or covers of waste containers.

BACKGROUND

Waste containers are mechanical devices that are typically used to hold discarded items. An example of a waste container includes a trash can or bin that is typically used to temporarily store garbage or other waste items. Waste containers often have lids that help hold and isolate the contents of the waste container. For example, lids can prevent the contents of waste containers from being exposed to wind, rain and snow. Lids can contain undesirable odors of the contents. Lids can also prevent the contents of waste containers from being accessed by domestic and wild animals scavenging for food.

To avoid a lid from being opened at inappropriate times, the lid and/or the bin of the waste container to which the lid is attached may include a latch mechanism. Such latch mechanisms for waste containers may benefit from improvements.

SUMMARY

The following is a brief summary of subject matter that is described in greater detail herein. This summary is not intended to be limiting as to the scope of the claims.

In one example embodiment described herein, a latch mechanism may be configured to be mounted to a waste container that includes a bin and a lid. Such a bin of the waste container includes walls that bound an interior space and an opening into the interior space, which is coverable by the lid. Such a lid may be attached to the bin via a hinge or other pivoting connection such that the lid is operative to pivot with respect to the bin between an open position and a closed position relative to the opening into the interior space.

When the lid is in the closed position, the lid includes an inside surface facing the interior space and the lid includes an opposed outside surface. In the examples described herein, the latch mechanism may be in operative connection with either the bin or the lid. For example, in an exemplary embodiment, the latch mechanism is in operative connection with the inside wall surface of the bin of the waste container and a release mechanism is in operative connection with the lid of the waste container.

The latch mechanism may automatically engage with the release mechanism in order to lock the lid in the closed position relative to the bin. However, it should be appreciated that in alternative embodiments the latch mechanism and release mechanism may be located in different locations. For example, the latch mechanism could be mounted in operative attached connection to the lid of the container and be operative to engage a release mechanism in operative attached connection with the bin. Also, in alternative embodiments, multiple outside and/or inside release mechanisms may be mounted to the waste container such as on the lid and/or on an upper ledge of the bin.

In an example embodiment, the release mechanism mounted to the lid is operative to enable a human to manually disengage the lid and the latch mechanism so that the lid may pivot to its open position. However, it should also be appreciated that in some applications, the waste container may also need to be configured to enable the lid to automatically open without direct manual intervention.

For example, waste disposal providers may employ a lifting mechanism to lift and rotate a waste container over a trash receptacle of a garbage truck. To avoid the lid from remaining closed and preventing the contents of the bin from falling out into the garage truck, the latch mechanism may be configured to automatically disengage from the release mechanism and permit the lid to rotate to an open position. In such an embodiment, the latch mechanism may be configured such that in certain predetermined dump angular orientations of the latch mechanism, gravity is operative to actuate portions of the latch mechanism to cause the latch mechanism to disengage from the release mechanism.

In general, both the hand operated exemplary release mechanism accessible from the outside of the lid (and optionally accessible from inside the waste container) and the automatic release features of the latch mechanism, are capable of maintaining a lid in a closed position when the waste container is in an upright position and a human is not engaging the release mechanism. However, some animals (such as raccoons) working individually or in groups may be capable of discovering methods of opening a lid of a waste container in order to access discarded food therein. Thus, example embodiments of the latch mechanism and release mechanism described herein may be configured to require specific actions to operate that are not capable of being discovered and/or carried out by most raccoons.

For example, raccoons working together may be capable of pushing a waste container on its side, which causes the waste container and latch mechanism to rotate 90 degrees. Thus, to prevent the lid from opening in this possible situation, an example embodiment of a latch mechanism may be operative to prevent the lid from opening unless the waste container and latch mechanism have rotated to a dump angular orientation, such as a range of predetermined angles (such as by more than 90 degrees). In this example embodiment, a dumping mechanism of a garbage truck or other device may lift and rotate the waste container by 120 degrees or more, and thus the described latch mechanism would still be operative to automatically disengage the lid for this use. However, on flat ground, a raccoon is much less likely to be able to rotate a waste container more than 90 degrees by tipping it over. Thus, the lid would remain shut when tipped over by a raccoon or other animal.

It should also be appreciated that aggressively tipping over a waste receptacle at only 90 degrees could impart a sufficient amount of kinetic energy, jarring, momentum, and/or centrifugal forces to internal parts of the latch mechanism to mimic the effect that gravity would have on the internal parts of a latch mechanism if a waste container were rotated by more than 90 degrees. Thus, to prevent the lid from opening in this possible situation, an example embodiment of a latch mechanism is operative to slow and/or mechanically prevent the automatic actuation of the release mechanism so as to provide time for the initial jarring effects of the fallen waste container to dissipate. Thus, only the angular orientation of the waste container and latch mechanism to the predetermined range of the dump angular orientation (e.g., more than 90 degrees) may cause the latch mechanism to disengage the lid from the waste container to enable it to open, and not the jarring forces caused by knocking a waste container on its side.

An example latch mechanism that is operative in this described manner may include a latch housing, an engagement portion, and a release weight. An example release mechanism for use with this described latch mechanism may include a release receptacle.

In this example, the latch mechanism may be mounted in fixed operative engagement to an inside wall of a waste container and the release mechanism may be mounted in fixed operative engagement to a wall of a lid of the waste container. In order to latch the lid to the waste container, the release receptacle is operative to engage with the engagement portion of the latch (when the lid is closed).

In this example, when the waste container it rotated from the upright condition by more than 90 degrees in at least one direction, the release weight may be operative to move responsive to gravity and the change in orientation to cause the engagement portion to disengage from the release receptacle, and thereby automatically enable the lid to rotate responsive to gravity to an open position relative to the waste container. Also, operative movement of the release knob relative to the release base causes the release receptacle to disengage from the engaging portion of the latch mechanism, to enable a human to manually unlatch the lid from the closed position closing the opening of the waste container.

Also, in this example, when the waste container is rotated back to an upright position (e.g., a zero degrees of rotation orientation), the release weight may be operative to move responsive to gravity to cause the engagement portion of the latch mechanism to change to a configuration that is operative to hold in latched engagement the release receptacle of the release mechanism (when the lid is placed in a closed position relative to the waste container).

An example latch mechanism that is operative to provide these features may include a release weight that is operative to move responsive to gravity in the latch housing from a first position, in which the weight is not in contact with the engagement portion, to a second position in which the weight is in contact with an engagement portion. The engagement of the weight and the engagement portion is operative to cause the engagement portion to change from a first configuration in which the engagement portion is enabled to hold the release mechanism in latched engagement, to a second configuration in which the engagement portion is enabled to disengage from the release mechanism. Also, the exemplary release weight may be operative to move responsive to gravity in the latch housing from the second position to the first position to cause the engagement portion to change from the second configuration to the first configuration.

In this exemplary embodiment, the rotary damper is configured to control and slow movement of the release weight in the latch housing from at least the first position to the second position. For example, the damper may be operative to slow movement of the release weight in the housing such that an amount of time for the release weight to move responsive to gravity from the first position to the second position is at least twice an amount of time the release weight would move responsive to gravity from the first position to the second position in the housing absent the effect of the damper on the release weight.

In this described embodiment, the engagement portion may include a release pin. The release pin includes an outer annular wall and an axial cavity therein. Also, the release pin has movable projection members (such as balls, spheres, vanes, fingers, etc.) that are operative to move between retracted positions and extended positions radially with respect to the outer wall of the release pin. In addition, the engagement portion may include a release pin button, wherein a portion of the release pin button extends in the cavity in the release pin. When the release weight moves from the first position to the second position of the release weight, the release weight is operative to engage and move the release pin button axially from a first button position to a second button position in the cavity in the release pin. In the second position of the release pin button, the projection members are enabled to move from the extended positions to the retracted positions.

In this example, the engagement portion may also include a spring in operative connection with the release pin button. When the release weight moves from the second position to the first position of the release weight, the spring is operative to automatically urge the release pin button to move from the second button position toward the first button position, which movement causes the release pin button to urge the projection members to move to the extended positions.

In example embodiments, the release mechanism further includes a release base and a release knob. Movement of the release knob relative to the release base from an extended position to a retracted position and then from a first angular orientation to a second angular orientation relative to the release base, enables the release receptacle of the release mechanism to disengage from the engagement portion of the latch mechanism.

In example embodiments, the described release receptacle comprises a release pin receptacle that is in operative connection with the release base. The release pin receptacle includes a rotatable portion that is operative to rotate between a first angular orientation and a second angular orientation. In the first angular orientation of the rotatable portion, the rotatable portion is operative to lockingly engage with the release pin when the projection members are in the extended positions and the knob is in the extended position.

Also in this example embodiment, movement of the release knob relative to the release base from the extended position to the retracted position of the knob and then from a first angular orientation to a second angular orientation of the knob relative to the release base, causes the rotatable portion to rotate to the second angular orientation of the rotatable portion, which orientation enables the release pin and release mechanism to disengage from each other while the projection member remains in the extended position.

The exemplary rotatable portion includes an aperture and inner ridges. The aperture is operative to receive the release pin therein. As the release pin moves inwardly in the aperture (to engage and hold the latch mechanism and release mechanism in engaged relation), the projection members in the extended position are operative to contact the inner ridges and cause the rotatable portion to rotate from the first angular orientation towards the second angular orientation. The rotatable portion is also configured such that when the release pin extends sufficiently far into the aperture to position the projection members inwardly past the ridges, the rotatable portion is operative to automatically rotate back to the first angular orientation. In addition, when the rotatable portion is in the first angular orientation and the release knob is in the extended position of the release knob, the inner ridges are operative to block the projection members in the extended positions of the projection members, from moving out of the aperture in the rotatable portion.

In this example embodiment, when the rotatable portion is moved to the second angular position by the knob, the inner ridges move to positions that enable the projection members in the extended positions to move outwardly past the inner ridges and enable the release pin and release pin receptacle to separate from each other. Also, in example embodiments, the rotatable portion is operative to rotate from the first angular position to the second angular position of the rotatable portion without causing the knob to rotate from the first angular position to the second angular position of the knob. In addition, when the release knob is in the extended position relative to the release base, the release knob is not operative to be rotated in a manner that causes the rotatable portion to rotate.

In example embodiments, the release mechanism further includes a torsion spring, an extension spring, and a compression spring. The torsion spring is configured to urge the rotatable portion to rotate from the second angular position to the first angular position of the rotatable portion. The extension spring is configured to urge the knob to rotate from the second angular position to the first angular position. Also, the compression spring is configured to urge the knob to move from the retracted position to the extended position.

Also, in example embodiments, each of two opposed walls of the release pin receptacle include guide channels. In addition, the latch housing includes guide flanges spaced apart from the release pin on opposed sides of the release pin. The guide channels are operative to receive the guide flanges of the latch housing when the latch mechanism engages with the release mechanism so as to enable self-alignment of the release mechanism with the latch mechanism which may initially be off center with respect to each other.

In example embodiments, the release weight may include a channel. Also, the previously described damper may include a rotatable shaft and a lever that extends from the rotatable shaft into the channel of the release weight. The channel has a shape that causes the lever to pivot and rotate the rotatable shaft from a first angular orientation to a second angular orientation when the release weight moves from the first position to the second position. Likewise, the configuration of the channel causes the lever to pivot and rotate the rotatable shaft from the second angular orientation to the first angular orientation when the release weight moves from the second position to the first position. The rotation of the rotatable shaft from the first angular position to the second angular position causes the damper to exert a first force on the release weight that slows movement of the release weight when moving from the first position to the second position.

Rotation of the rotatable shaft from the second angular position to the first angular position causes the damper to exert a second force on the release weight that slows movement of the release weight from the second position to the first position. In an example embodiment, the first force may be several times greater than the second force.

In example embodiments, the latch housing may include a housing ridge adjacent the release weight. Also, the latch mechanism may include a weight stopper in pivoting connection with a cavity in the release weight. In a first set of angular orientations of the latch mechanism (such as when the release weight is upright or angled on its back hinged side at −90 degrees of rotation from an upright position), the exemplary weight stopper is operative responsive to gravity to rotate so as to extend adjacent to the housing ridge and prevent gravity from causing the release weight from moving from the first position to the second position. Also, in a second set of angular orientations of the latch mechanism (such as a dump angular orientation greater than +120 degrees from an upright position), the weight stopper is operative to rotate away from the housing ridge and enable the release weight to slide from the first position to the second position responsive to gravity and the change in orientation.

In an alternative example embodiment, the described release mechanism may further comprise an inside release mechanism having a pull handle. The pull handle may include a flexible linkage that extends into operative connection with the rotatable portion. Pulling of the handle outwardly (by a human) from the latch mechanism causes the flexible linkage to cause the rotatable portion to rotate from the first angular position to the second angular position of the rotatable portion (which disengages the release mechanism and the latch mechanism from latched engagement). In addition in this described alternative embodiment, the release mechanism includes a handle holder that is operative to hold the handle in a position such that the flexible linkage does not urge the rotatable portion to rotate from the first angular position to the second angular position.

Other aspects of exemplary embodiments will be appreciated upon reading and understanding the attached figures and description.

DETAILED DESCRIPTION

Figure 1:
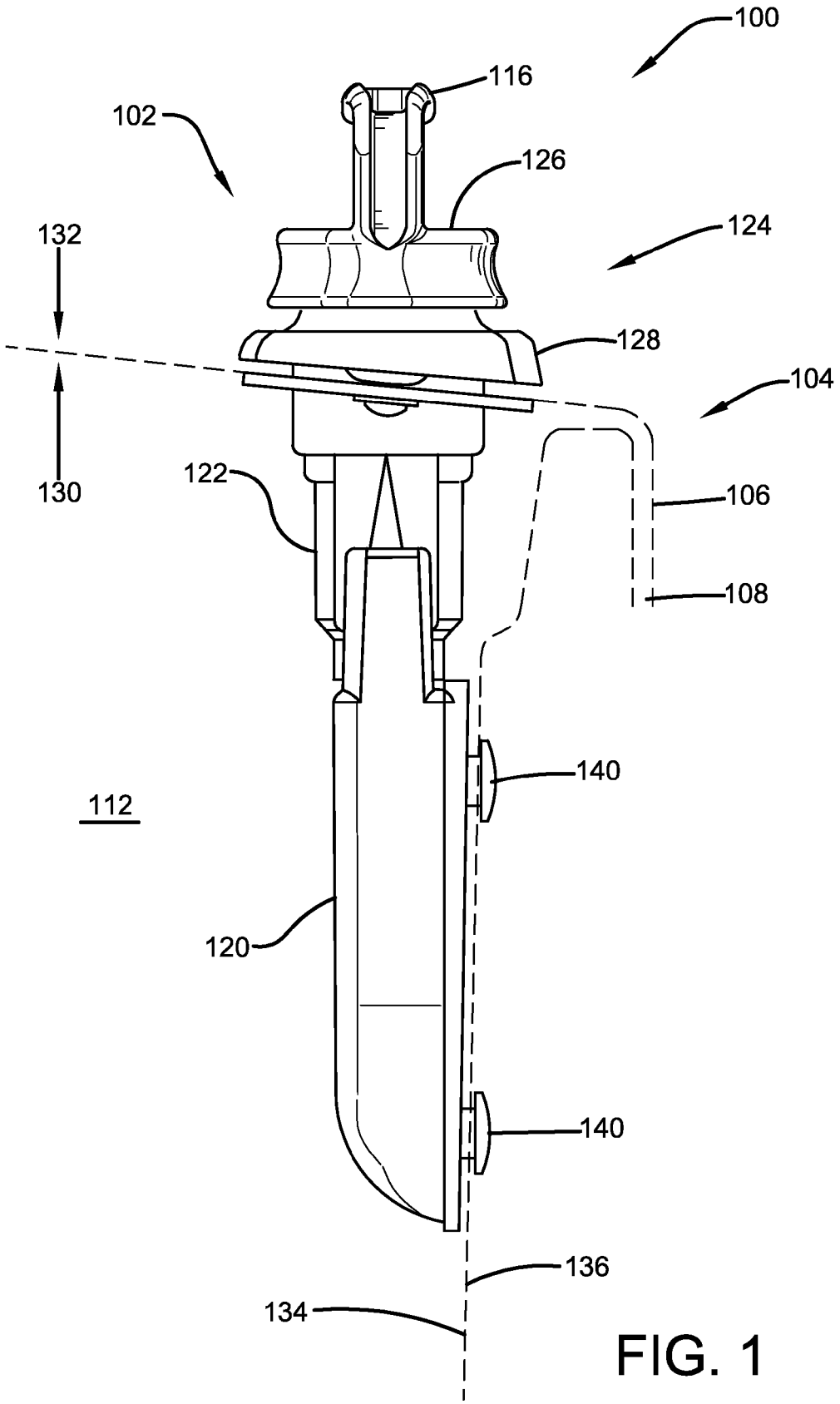
FIG. 1 is a side view of an example apparatus that facilitates latching and unlatching a lid in a closed position to a bin of a waste container.

Various technologies pertaining to latch and release mechanisms for waste containers will now be described with reference to the drawings, where like reference numerals represent like elements throughout. In addition, the example systems are illustrated and described herein for purposes of explanation; however, it is to be understood that functionality that is described as being carried out by certain system components may be performed by multiple components. Similarly, for instance, a component may be configured to perform functionality that is described as being carried out by multiple components.

FIG. 1 is a side view 100 of an exemplary apparatus 102 that facilitates latching and unlatching a lid 106 to a bin 108 of waste container 104. Such a lid 106 may, for example, be in pivoting connection with the bin 108 of the waste container via one or more hinges. The lid may pivot from the closed position shown in FIG. 1 to an open position in which an opening to the cavity 112 inside the bin is accessible to load or unload articles (e.g., garbage/trash). The elements of the hinge (not shown in FIG. 1) may be formed integral with the lid and waste container elements. However, it should be appreciated that in some embodiments, hinge mechanisms may be fastened to the lid and bin of the waste container to enable the lid and bin to pivot with respect to each other.

In an example embodiment, the lid and bin of the waste container may be made of a plastic material such as a high density polyethylene (or other plastic such as a polypropylene) via a manufacturing process such as blow molding, injection molding, or other molding process. However, it should be appreciated that in alternative embodiments, the lid and bin of the waste container may be made out of other materials such as metal (e.g., aluminum or steel).

Figure 2:
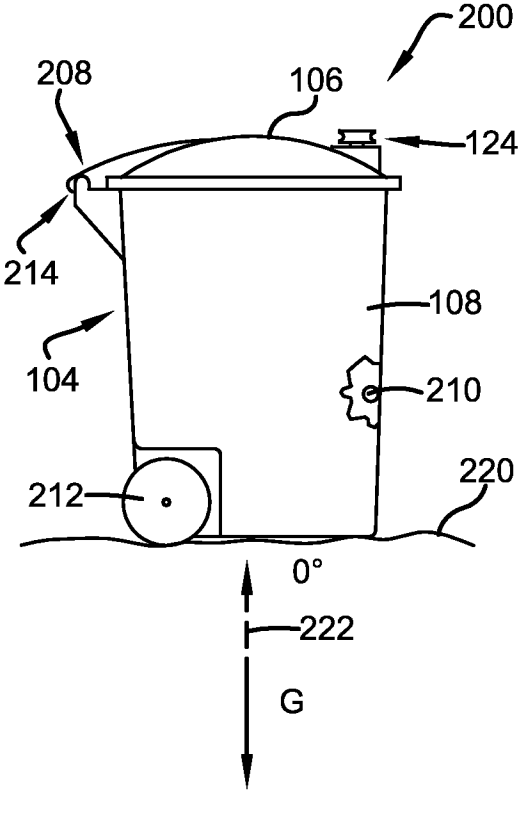

FIG. 2 is a side view 200 of the exemplary waste container 104 including the lid 106 and the bin 108, which is usable with the latch mechanisms described herein. The lid and bin may be coupled via integral hinge portions 208. In FIG. 2, the waste container is shown in an upright orientation 222 relative to the ground 220 and direction of gravitational force G with the opening to the cavity being generally horizontal and the top of the closed lid 204 facing upwardly. This upright orientation 222 corresponds to the waste container being rotated zero degrees (i.e., it is not rotated from this upright position).

In this example, the waste container 104 includes features that enable the waste container to be lifted, rotated and unloaded via a lifting mechanism of a dump truck or other dumping device. Such features, for example, may include a metal horizontal retention bar 210 that extends in a recess bounded by exterior walls of the bin. Such a waste container 104 may also include wheels 212 and a handle 214. In the U.S., such waste containers may be compatible with a standard such as ANSI Z245.60—2008 which is incorporated herein by reference in its entirety. Also, such waste containers may have different interior capacities such as 26 gallon, 32 gallon, 64 gallon, or 96 gallon sizes, or other waste container sizes. Thus, it should be appreciated that embodiments of the latch and release mechanisms described herein may be adapted for use with any type and/or configuration of a waste container that includes a lid.

Figure 4:
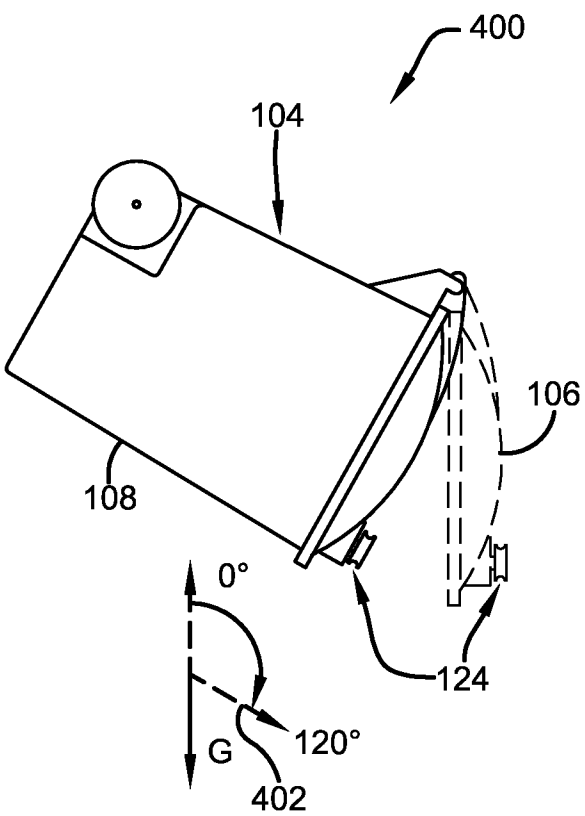
FIGS. 2-4 are side views of a waste container in different angular positions of rotation.
Figure 3:
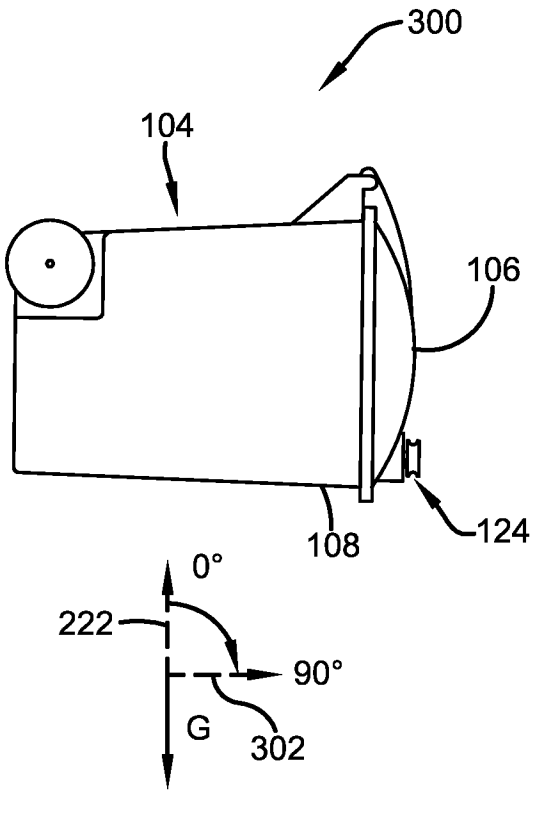

FIGS. 3 and 4 show example orientations of the waste container as it is being rotated by a lifting mechanism (however, the lifting mechanism is not shown). In particular, FIG. 3 illustrates an example side view 300 of the waste container 104 in a rotated orientation relative to the ground 220 and direction of gravitation force G with the top of the closed lid 204 facing sideways. This sideways orientation 302 corresponds to the waste container being rotated +90 degrees from the upright orientation 222 shown in FIG. 2.

FIG. 4 illustrates an example side view 400 of the waste container 104 in a further rotated orientation relative to the ground 220 and direction of gravitation force G with the lid being operative to rotate responsive to gravity away from its closed position. This downwardly angled orientation corresponds to the waste container being rotated about +120 degrees from the upright orientation 22 shown in FIG. 2. At this angle (or other range of downwardly sloping angles referred to herein as dump angle orientation), the exemplary lid is operative to automatically become unlatched (as will be described below in more detail) to allow the contents of the waste container to be unloaded by being dumped out through the opening to the cavity which is directed at least somewhat downward.

Referring again to FIG. 1, the example apparatus 102 may include a latch mechanism 120 which is alternatively referred to herein as a latch, and an outside release mechanism 124. When the lid 106 is in a closed position relative to the bin 108, and the waste container 104 is in the upright position shown in FIG. 2, the latch is operative to be held in latching engagement with a release receptacle 122 of the release mechanism 124 to prevent the lid from pivoting to its open position. To enable the lid to open, the release mechanism 124 is configured to be operated by a user in order to actuate portions of the latch that enable the latch to disengage from the release mechanism.

The exemplary outside release mechanism includes a movable element such as a knob 126. Such a knob may include a handle 116. The knob is in operative connection with a base 128. The exemplary base has an outer shape that is compatible with the surface configuration of the lid 106. For example, as shown in FIG. 1, the lid 106 slopes downwardly to an end of the lid. The base 128, for example, may be configured to mount to such a sloped surface while orientating the knob, such that an axis of rotation of the knob is substantially vertical in the upright orientation of the waste container.

However, it should be appreciated that in alternative embodiments, the base may be configured to orientate the knob at other angular orientations and may be adapted to mount to lids or sides of waste containers with other slopes and surface designs. Also, in alternative embodiments of the outer release mechanism, rather than having a knob shape, the movable element may have the shape of a paddle, lever, button, handle, or any other configuration that is capable of being manipulated by a user to actuate the release mechanism. Further, exemplary embodiments may include knobs or other manually movable members that are required to be moved in two different directions in order to enable the latch to be unlatched. Such directions may include linear directions, rotational directions or combinations thereof. Examples of different knobs, and other components that may be adapted for use with the embodiments described herein and or that may be adapted to use the features described herein are shown in U.S. Patent Applications Nos.: 61/984,464 filed Apr. 25, 2014; 61/984,428 filed Apr. 25, 2014; Ser. No. 29/489,045 filed Apr. 25, 2014; Ser. No. 29/489,172 filed Apr. 28, 2014; and Ser. No. 29/509,434 filed Nov. 18, 2014, which are hereby incorporated herein by reference in their entirety.

As shown in FIG. 1, the latch 120 may be mounted to an inside surface 134 of a side wall 136 of the bin 108. When the lid 106 is in a closed position, an inside surface 130 of the lid faces inwardly toward the cavity 112, while opposed outside surfaces 132 of the lid face outwardly. In this example, portions of the release mechanism such as the knob 126 and release base 128 may be mounted adjacent to the outside surface 132 of the lid 106, while other portions of the release mechanism, such as the release receptacle 122, are positioned adjacent the inside surface 130 of the lid 106. However, it should be appreciated that in alternative embodiments, these elements may be mounted to the waste container in other orientations. For example, alternative embodiments of the latch 120 may be mounted to the lid 106, while the release mechanism is mounted to the side wall 136 of the bin 108.

In order to mount these described elements to the waste container, the latch mechanism and outside release mechanism may include threaded bores and/or apertures. Such bores or apertures may accommodate the use of fasteners 140 such as of bolts, screws, nuts (or any other type of fasteners or other items that are operative to hold these elements to the waste container).

Figure 5:
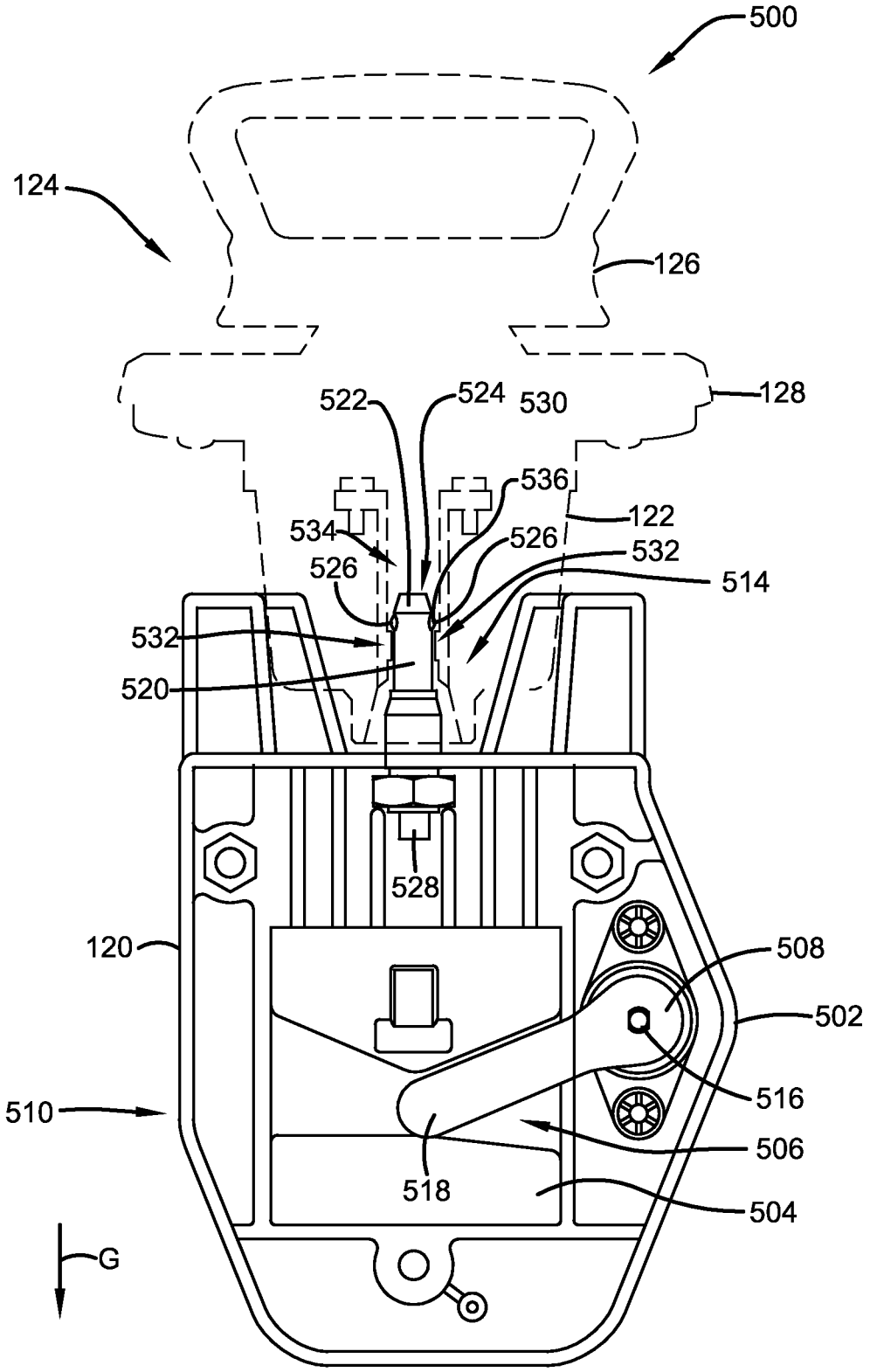
FIGS. 5-6 are inside views of the exemplary latch mechanism at different angular orientations.
Figure 6:
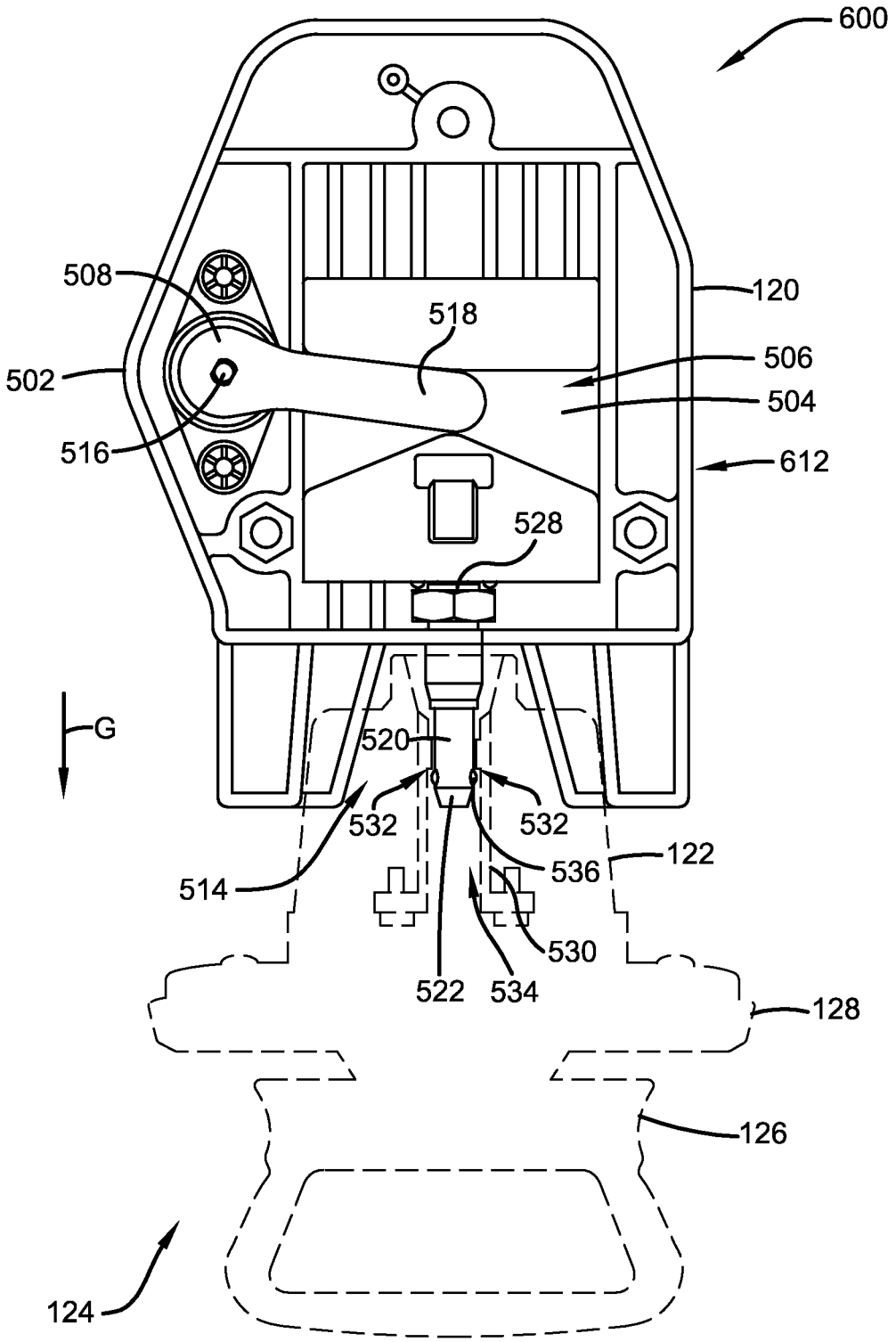

FIGS. 5 and 6 illustrate example operations of the latch 120. FIG. 5 shows a side internal view 500 of the latch mechanism in a neutral configuration. Such a neutral configuration corresponds to an orientation of the internal elements of the latch mechanism when the waste container to which it is mounted in an upright (zero degrees) orientation 222 with the lid closed (such as shown in FIGS. 1 and 2). FIG. 6 shows a side internal view 600 of the latch mechanism in an internal release configuration. The internal release configuration corresponds to an orientation of the internal elements of the latch when the waste container to which it is mounted is rotated to the dump angular orientation 402 (e.g., +120 degrees or range downwardly sloped angles) with the lid operative to open (such as shown in FIG. 4). Thus, the latch in FIG. 6 is shown being inverted compared to the orientation shown in FIG. 5.

With reference to FIGS. 5 and 6, the exemplary latch 120 includes a latch housing 502. Mounted in the housing is a movable release weight 504. The release weight includes at least one channel 506 in at least one side of the release weight. In addition, the latch may include, mounted in the housing, at least one damper such as the rotary damper 508. Also, the latch may include an engagement portion 514 that is configured to be engageable with the release receptacle 122 of the release mechanism 124 (shown in phantom).

When the latch 120 is rotated from the neutral orientation shown in FIG. 5 to the inverted orientation (corresponding to the dump angular orientation) shown in FIG. 6, the release weight is operative to move responsive to gravity G and the change in orientation from a first position 510 to a second position 612. In the second position the weight is in operative connection with the engagement portion 514 and causes the engagement portion to change to a configuration that is operative to enable the release mechanism to disengage from the engagement portion of the latch mechanism.

In this described example, the damper 508 includes a rotatable shaft 516 and a lever 518 that extends from the rotatable shaft into the channel 506 of the release weight 504. The exemplary channel has a shape that causes the lever 518 to pivot and rotate the rotatable shaft 516 from a first angular orientation (shown in FIG. 5) to a second angular orientation (shown in FIG. 6) when the release weight moves from the first position 510 to the second position 612. Likewise, the shape of the channel 506 causes the lever 518 to pivot and rotate the rotatable shaft 516 from the second angular orientation to the first angular orientation when the release weight moves from the second position 612 to the first position 510.

In this example, the rotation of the rotatable shaft 516 from the first angular position to the second angular position causes the damper to exert a first force on the release weight 504 (opposite to the direction of movement of the release weight) that controls and slows movement of the release weight from the first position to the second position.

It should also be noted that the rotation of the rotatable shaft 516 from the second angular position (shown in FIG. 6) to the first angular position (shown in FIG. 5) causes the damper to exert a second force on the release weight that slows movement of the release weight from the second position 612 to the first position 510. In this described example embodiment, the first force may be several times greater than the second force. However, in alternative embodiments, the first and second forces may be substantially the same. As an example of the forces capable of being generated by an example rotary damper 508, the damper may be capable of producing a damping torque on the rotatable shaft rotating at 20 rpm at 23° C. of between 0.1 to 2.0 Ncm.

In the exemplary embodiment, the pin 518 includes a rounded end disposed away from the damper. The rounded end is configured so as to enable the lever to move in readily sliding engagement with the walls bounding the channel 506. In some exemplary arrangements, the curved end of the lever 518 and the channel walls may be polished or otherwise configured or treated with a material that facilitates relative movement of the channel walls and the end of the lever. In other arrangements, the end of the lever may include a rotatable member such as a roller, which may further facilitate the ability of the weight to move without being limited by frictional engagement between the lever and the walls bounding the channel 506.

It should be further noted that in the exemplary embodiment, the wall bounding the channel on the side that is disposed the furthest away from the engagement portion 514 is angularly configured to be sloped in a direction away from the engagement portion and outwardly to the lateral side of the weight on which the damper is located. This configuration in the exemplary embodiment is configured to cause the force of the damper, which resists movement of the weight and which acts through the rounded end of the lever, to act generally along the line of movement of the weight between the first and second weight positions. The configuration of the wall bounding the channel surface in this way enables the exemplary embodiment to assure that the force applied by the damper and acting to resist movement of the weight, acts almost entirely in the direction of the weight movement and does not have significant angular components to the force which might cause the weight to twist or otherwise become stuck so as to limit its movement. As can be appreciated, if the force applied by the damper were to act in a manner that would twist or otherwise cause the weight to move in a direction other than along the linear direction within the housing, this might result in a greater tendency of the weight to become twisted and stuck.

Further in the exemplary embodiment, the angle of the wall bounding the channel in the direction that is disposed away from the engagement portion 514, has a very low slope angle that extends from the center of the channel outward to the periphery of the weight. This low angle of slope also conforms with the configuration of the side of the lever 518. Thus for example, as can be seen in FIG. 6, when the weight has moved to its second position, the wall of the lever and the angled wall bounding the channel of the weight on the side disposed away from the engagement portion are in parallel relation. This configuration serves to positively limit the travel of the weight to the second position. This is because the lever 518 is unable to rotate further in the clockwise direction shown in FIG. 6 beyond the position shown. Further, the significant length of parallel engagement of the lever and the surface bounding the weight helps to absorb forces and reduces the risk that the lever arm will be bent or otherwise damaged by movement of the weight.

Further in the exemplary arrangement as represented in FIG. 5, the wall surface bounding the channel is configured to similarly engage the opposed side wall bounding the lever 518 when the weight is in the first position. This configuration likewise limits the travel of the weight in a direction away from the engagement portion 514 to the first position of the weight in which the wall bounding the lever and the wall bounding the channel extend generally parallel in engagement. This feature further reduces the risk of damage to the lever due to deformation or otherwise resulting from harsh movements of the weight. Of course it should be understood that these configurations are exemplary and in other arrangements other configurations may be used.

Further it should be understood that while one rotary damper is utilized in connection with the exemplary embodiment, in other embodiments other configurations and types of dampers may be used. This may include for example rotary dampers positioned on both lateral sides of the weight so as to control the movement thereof between the first and second positions. Such rotary dampers may include lever arms that engage the same side, or alternatively, opposed lateral sides of the weight. Further in still other embodiments, other types of damper mechanisms that control or limit the speed of movement of the weight may be utilized. Such dampers may include torsional dampers that utilize springs, gears, etc. Alternatively, fluid dampers such as hydraulic or pneumatic dampers for other suitable devices may be utilized in other embodiments.

In an example embodiment, the damper is operative to dampen and control movement of the release weight in the housing such that an amount of time for the release weight to move responsive to gravity from the first position 510 to the second position 612 is at least twice an amount of time the release weight would move responsive to gravity from the first position to the second position in the housing absent the effect of the damper on the release weight.

In this described embodiment, the engagement portion 514 includes a release pin 520. The exemplary release pin includes an outer wall 522 and an axial cavity 524 therein. In addition, the release pin is in movable connection with projection members 526 (e.g., in the exemplary embodiment a plurality of small balls or spheres). The exemplary projection members are operative to move between radially extended positions (as shown in FIG. 5) and retracted positions (e.g., in which the balls are not visible in FIG. 6) in which the projection members are retracted radially with respect to apertures 536 in the side of the outer wall 522 of the release pin 520.

As can be appreciated in the exemplary embodiment, the projection members 526 are configured to move radially within the apertures of the release pin, and in the exemplary configuration the apertures are configured to enable the projection members to move, but not pass entirely therethrough. Further it should be understood that while in the exemplary arrangement balls or spheres are used as projection members, in other arrangements other types of movable members such as tabs, fins, vanes or other elements that capable of being selectively extended and retracted may be used as projecting members.

Example embodiments of the engagement portion 514 include a release pin button 528. At least a portion of the release pin button 528 extends axially in the cavity 524 in the release pin. When the release weight moves from the first position 510 (shown in FIG. 5) to the second position 612 (shown in FIG. 6) the release weight is operative to engage and move the release pin button 528 from a first position to a second position which causes axial movement of the button that extends in the cavity in the release pin. In the second position of the release pin (as shown in FIG. 6), the release pin button is operative to enable the projection members 526 to move from the extended positions to the retracted positions. This is accomplished in the exemplary embodiment by the button including annular recesses or discrete pockets which are configured to enable the projection members to move radially inwardly so as to retract when the portion of the button including the recesses or pockets moves into alignment with the projection members.

However, when the release weight moves from the second position 612 (shown in FIG. 6) to the first position 510 (shown in FIG. 5), a spring is operative to urge the release pin button to move from the second position to the first position of the release pin button. This movement causes the release pin button to move so that the recesses or pockets in the button within the axial cavity are no longer adjacent the projection members and the outer wall bounding the button portion in the cavity urges the projection members 526 to move to the extended positions (shown in FIG. 5).

In this example, the release receptacle 122 corresponds to a release pin receptacle that is operative to receive and engagingly hold the release pin 520. The release pin receptacle 122 includes a rotatable portion 530 having an aperture 534. The release pin may slide into and out of engagement with the aperture 534. The rotation portion includes radially inward extending inner ridges 532 inside the aperture 534. When the projection members 526 of the release pin are in the extended position, the inner ridges 532 are operative to engage the projection members to prevent the release pin 520 from sliding out of the aperture 534 of the release pin receptacle 522.

Figure 16:
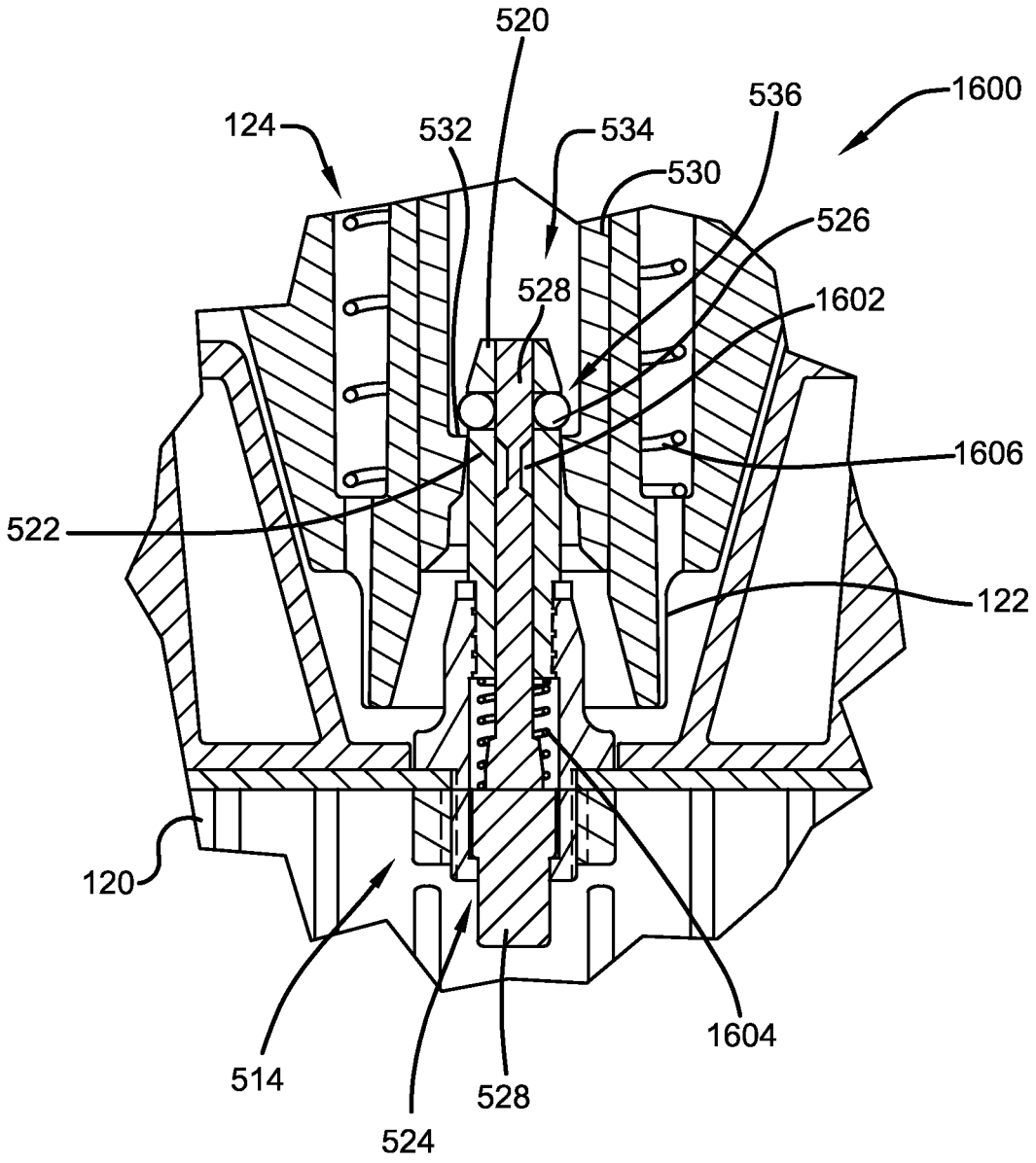
FIGS. 16-18 are side cross-section views illustrating engagement and disengagement of portions of the latch mechanism and release mechanism.
Figure 17:
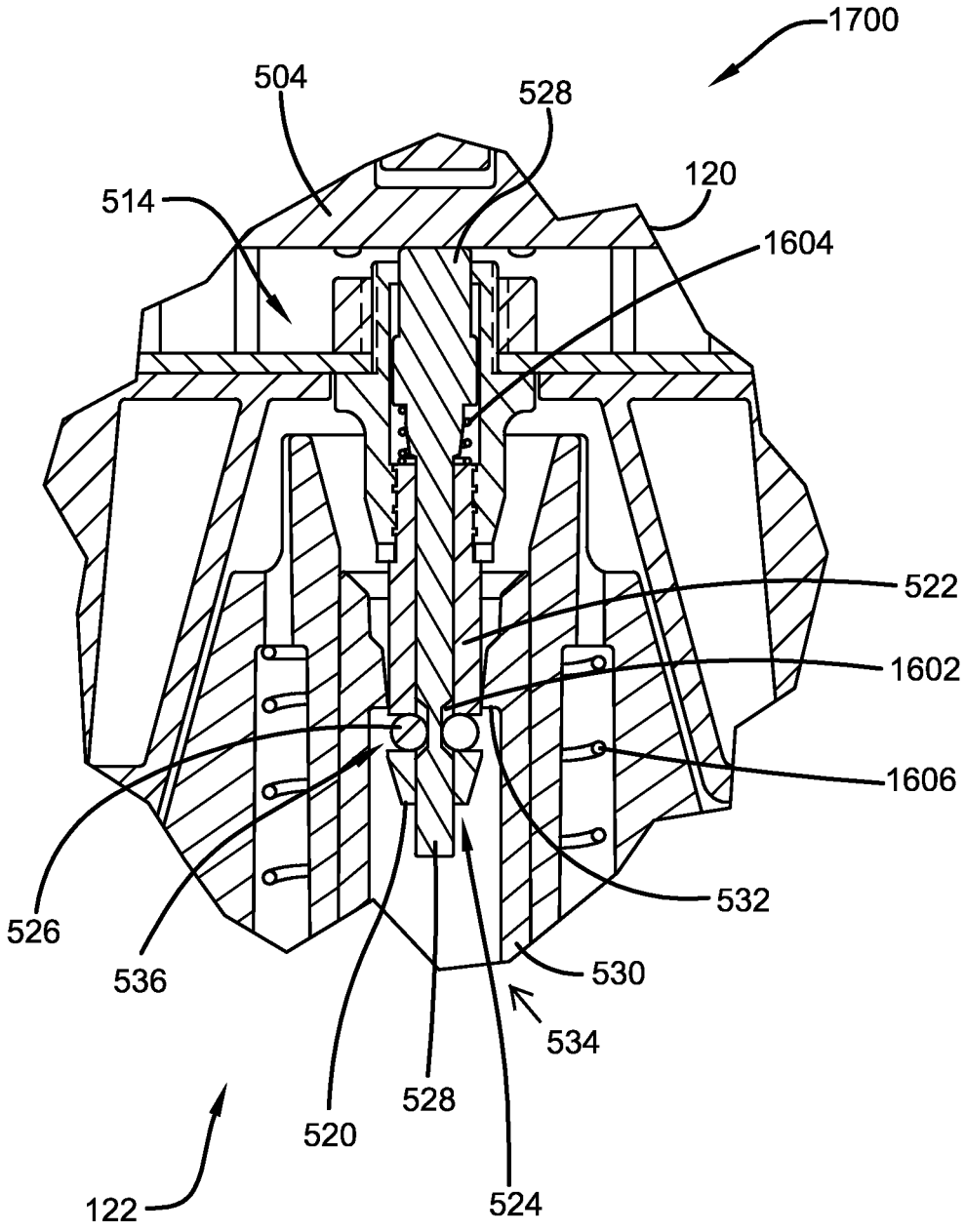

To assist further understanding of these described features, FIGS. 16 and 17 show cross-sectional views 1600, 1700 of the exemplary engagement portion 514 that is positioned inside the release pin receptacle 122 of the release mechanism 124. FIG. 16 shows a configuration of the engagement portion that corresponds to what is shown in phantom FIG. 5. FIG. 17 shows a configuration of the engagement portion that corresponds to FIG. 6.

As shown in FIG. 16, the release pin button 528 includes the annular recess or pockets which are alternatively referred to herein as channels 1602 in the annular side wall of the release pin button within the axial cavity of the release pin. In FIG. 16, with the release button in the first axial position, such channels are not aligned with the projection members. Thus, the relatively wider diameter portion of the annular wall of the release pin button above the channels 1602 pushes the projection members radially outwardly. Also as shown in FIG. 16, the exemplary engagement portion 514 includes a spring 1604 that is configured to urge the release pin button 528 relative to the cavity 524 axially inward toward the first position shown in FIG. 16. Thus, when the release weight is not contacting the release pin button, the spring 1604 acting on the release pin button causes the projection members to move to their extended positions.

As discussed previously, this enables latched holding engagement of the release pin and with the release pin receptacle 122 when the release pin 520 is inserted sufficiently far into the aperture 534 of the rotatable portion 530 to place the projection members 526 adjacent the ends of the inner ridges 532 along the walls of the aperture 534. In this position, the top sides of the inner ridges 532 are operative to block the projection members extending radially outward from the release pin 520 from disengaging sliding out of the aperture 534 of the release pin receptacle 122.

However, as illustrated in FIG. 17, when the described latch is inverted in a dump angular orientation, and the release weight 504 pushes down on the release pin button 528, the spring 1604 becomes more compressed and the channels 1602 in the sides of the release pin button 528 become aligned with the projection members 526. These channels provide space for the projection members to move radially inwardly to their retracted positions. This causes the distance between the outermost portions of the projection members 526 to be less than the diameter of the portions of the aperture 534 between the inner ridges 532. As a result, the release pin 520 is enabled to slide out of the aperture 534 of the rotatable portion 530 and enables the engagement portion 514 of the latch to disengage from the release pin receptacle 122 of the release mechanism, thus changing from a latched condition to an unlatched condition.

With this described design, the latch permits the lid of the waste container to become automatically unlatched and opened when a lifting mechanism of a garbage truck (or other device) lifts and rotates the waste container to a dump angular orientation which in the exemplary configuration is an angle greater than the sideways angular orientation shown in FIG. 3 (e.g., 90 degrees) and in a range which includes the downwardly sloped angular orientation shown in FIG. 4 (e.g., 120 degrees) or a more steep angle. In this exemplary configuration, if an animal such as a raccoon merely knocks the waste container on its side (as shown in FIG. 3) the lid of the waste container is likely to remain latched and closed.

It should be appreciated that when a lid of a waste container is moved to a closed position, the engagement portion 514 of the latch will become engaged with the release pin receptacle 122. The release pin 520 will move into the aperture 534 of the rotatable portion 530 of the release pin receptacle 122 and the projection members will engage the inner ridges 532 to hold the latch and the receptacle in engagement.

When closing the lid of the waste container, in order to enable the projection members to pass the described inner ridge members when engaging the latch mechanism with the release mechanism, the described rotatable portion 530 of the release pin receptacle 122 is operative to rotate responsive to urging forces applied by the inwardly moving projection members themselves. In this example, the inner ridges 532 have a tapered angled helix configuration facing toward the opening of the aperture 534. For example, FIG. 24, which shows an example configuration of the inner ridges 532 in a bottom view 2400 of the rotatable portion 530.

As the projection members slide inwardly in engagement with the tapered and angled surfaces of the inner ridges 532, the radially extending projection members 526 function as cam surfaces that provide rotation force to turn the rotatable portion 530 a sufficient distance for the projection members to reach relatively wider channels 706 in the aperture 534. Such wider channels 706 in the aperture 534 provide sufficient space for the projection members to slide past the adjacent inner ridges.

In addition, as shown in FIG. 16 the release pin receptacle 122 is in operative connection with a torsion spring 1606. The cam action of the extended projection members causes rotational movement of the angled inner ridges that overcomes the biasing force of the torsion spring. When the extended projection members slide inwardly past the adjacent inner ridges 532, the torsion spring 1606 is configured to cause the rotatable portion 530 to rotate in the opposite direction that the rotatable portion was caused to be turned by the inward movement of the projection members. As a result, the ends of the inner ridges rotate to be positioned outwardly of the projection members 526 and block the projection members and release pin from sliding back out of the aperture 534 of the rotatable portion 530.

As discussed previously with respect to FIG. 1, the exemplary release mechanism 124 may correspond to an outside release mechanism. Such an outside release mechanism may have a configuration that enables a user to disengage the release mechanism from the latch (from outside the waste container) so as to permit the lid to pivot to an open position when the waste container is in an upright orientation (such as shown in FIG. 2).

Figure 8:
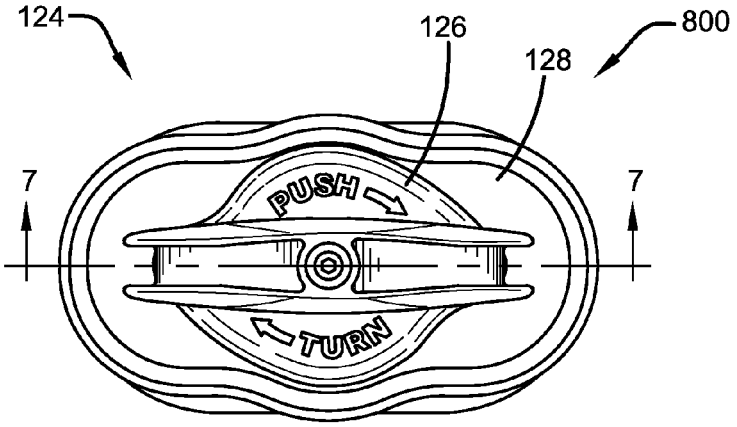
FIGS. 7-15 are cross-sectional and top views of an exemplary release mechanism for different configurations of the elements of the release mechanism.
Figure 7:
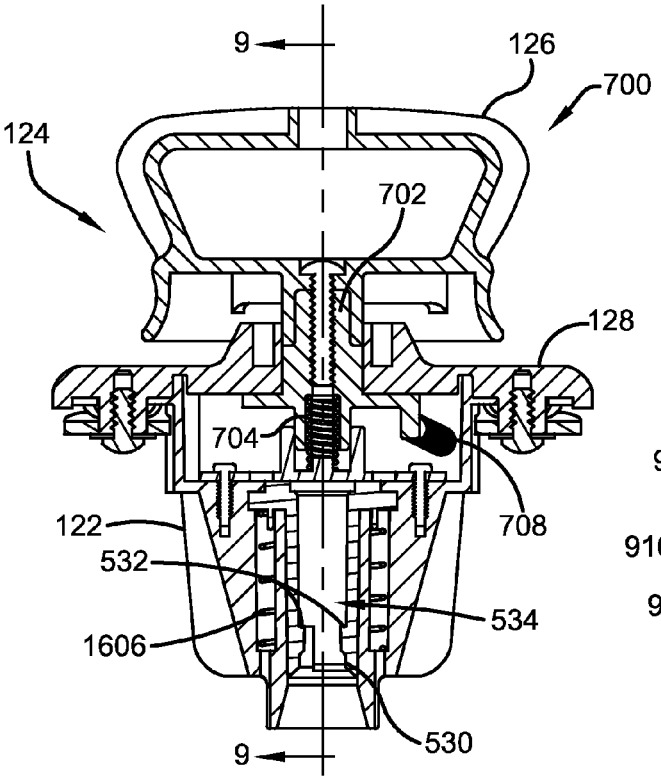
Figure 9:
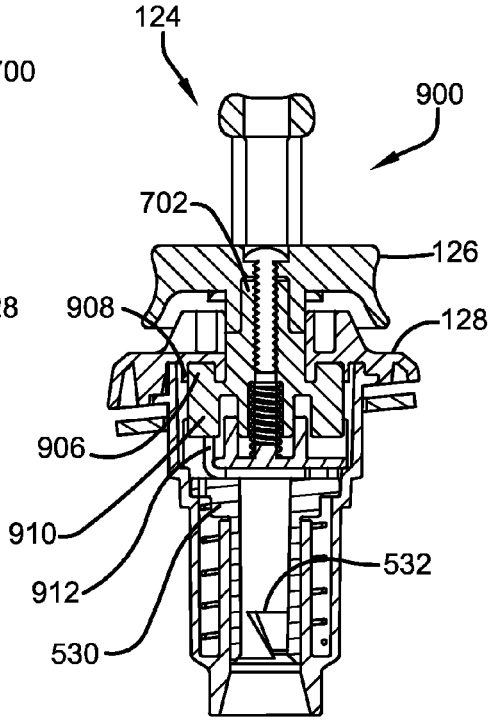

FIGS. 7-15 illustrate operations of the exemplary release mechanism 124. FIGS. 7, 8, and 9 are respectively a front cross-sectional view 700, a top view 800, and a side cross-sectional view 900 of the release mechanism in a neutral configuration. As used herein, the neutral configuration corresponds to an orientation of the elements of the release mechanism when the release mechanism is not being manipulated by a human to disengage the release mechanism from the latch mechanism.

Figure 11:
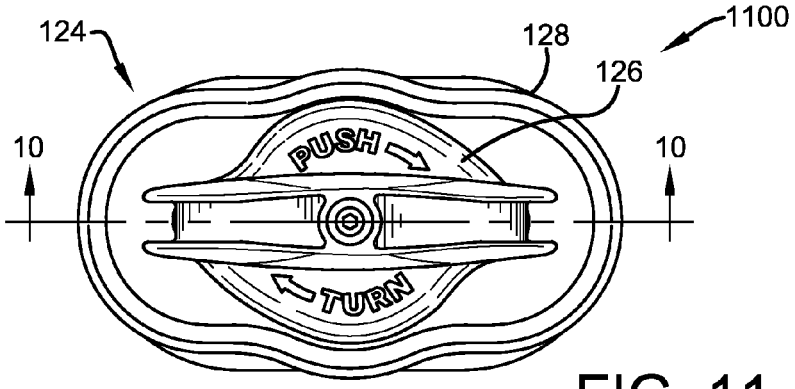
Figure 10:
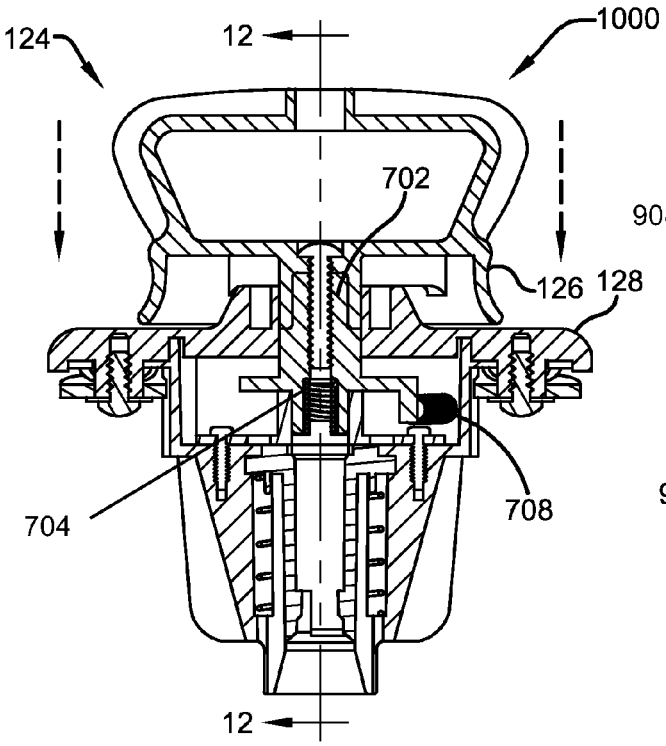
Figure 12:
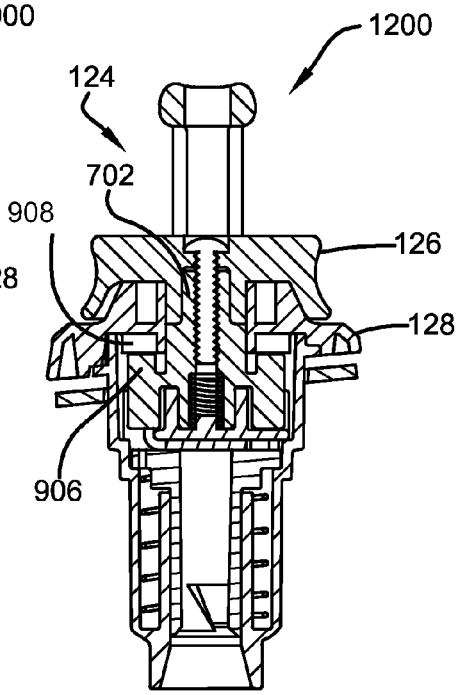

FIGS. 10, 11, and 12 are respectively a front cross-sectional view 1000, a top view 1100, and a side cross-sectional view 1200 of the release mechanism in an intermediate release configuration after the knob 126 has been pushed axially downwardly (inwardly) by a human (to be relatively more compacted in combination with the base 128).

Figure 14:
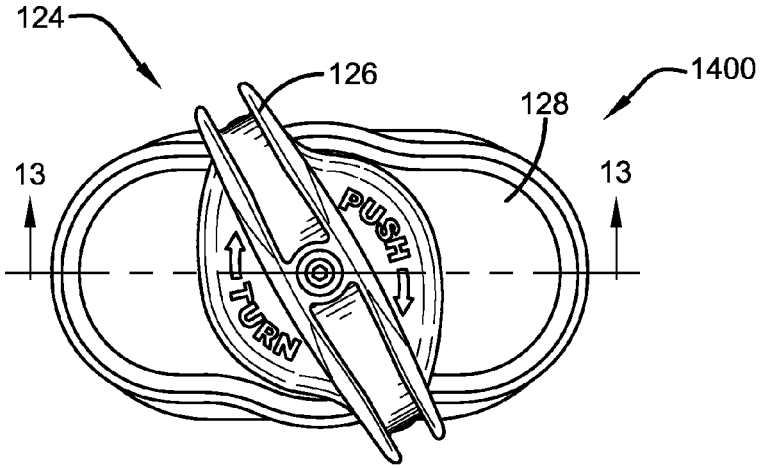
Figure 13:
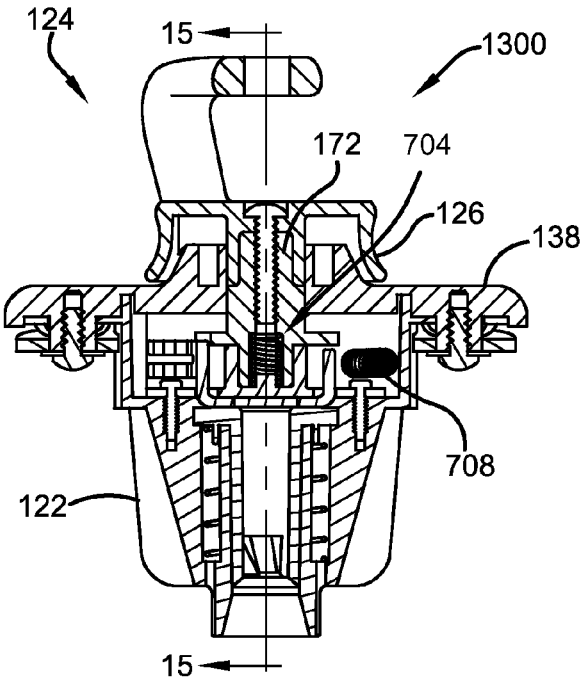
Figure 15:
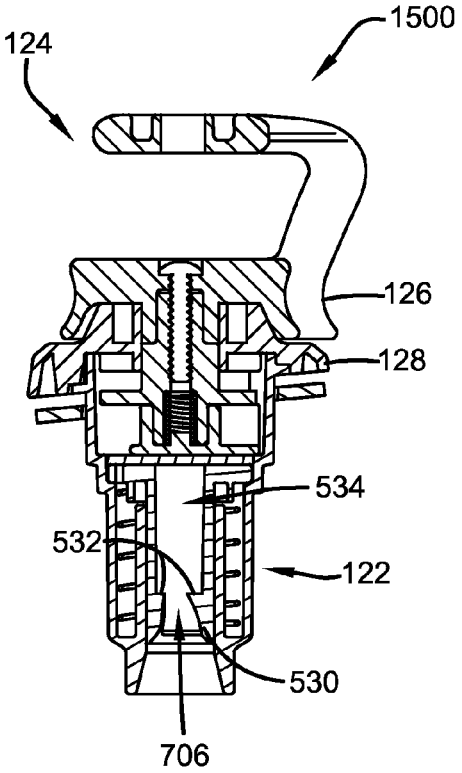

FIGS. 13, 14, and 15 are respectively a front cross-sectional view 1300, a top view 1400, and a side cross-sectional view 1500 of the release mechanism in a release configuration when the knob 126 is both pushed axially downwardly and is rotated with respect to the base 128. As used herein, the release configuration corresponds to an orientation of the elements of the release mechanism when the release mechanism is enabled to become disengaged from the latch.

Referring now to FIG. 7, the knob 126 of the exemplary release mechanism 124 may be fastened to a shaft 702 that extends in a cavity in the base 128. A compression spring 704 may biasingly act between portions of the shaft 702 and the base 128 so as to urge the shaft 702 and knob 126 to an axially extended position relative to the base 128. As shown in FIG. 9, when the knob is in the extended position, projections 906 on the shaft 702 may be positioned in apertures 908 in the wall portion of the release base to prevent the knob from rotating.

Also, as shown in FIG. 7, in the neutral position, the previously described rotatable portion 530 is typically positioned so that the previously described relatively wider channels 706 in the aperture 534 between the inner ridges 532 are rotated away from the locations that the radially outward projecting members on the latch pin will be located when the latch is in latched engagement with the release mechanism 124 (such as shown in FIG. 16).

Referring now to FIG. 12, when the knob 126 (and shaft) is moved to the retracted (axially inward) position relative to the base 128, the projections 906 in the shaft 702 associated with the knob move inwardly below the apertures 908. Thus, in the intermediate orientation shown in FIGS. 10-12, the knob is free to either move back to the axially extended position (via the urging forces of the compression spring 704) or be rotated while in the retracted axially inward position.

As shown in FIG. 9, the shaft 702 may include flanges 910 that extend adjacent to projections 912 in operative connection with the previously described rotatable portion 530. Thus, when the knob 126 is rotated to the positions shown in FIGS. 13-15, the flanges 910 (shown in FIG. 9) engage and push against the projections 912 and urge the rotatable portion 530 to rotate as well. As shown in FIG. 15, the rotation of the rotatable portion 530 in this manner is operative to align the relatively wider channels 706 (also shown in FIGS. 7 and 24) between the inner ridges 532 in the aperture 534 with the locations that the projecting members of the release pin will be located when the latch mechanism is in latched engagement with the release mechanism.

Figure 18:
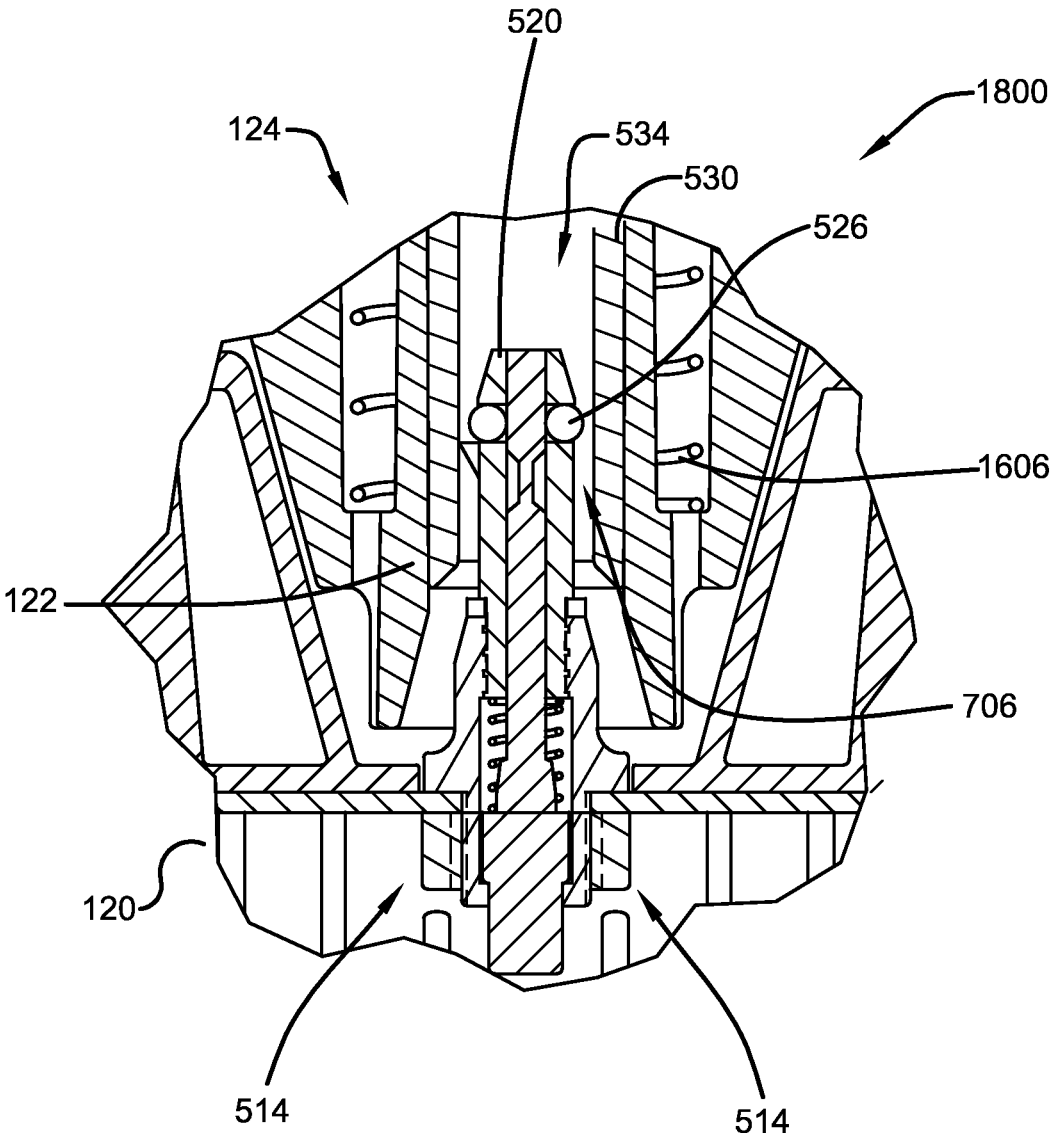

To illustrate this configuration more clearly, FIG. 18 depicts the cross-sectional view 1800 of the exemplary release mechanism that is in the release configuration that is shown in FIG. 13. FIG. 18 also shows the location of the release pin 520 with the projection members in their radially extended state. However, because the rotatable portion 530 has been rotated to the position shown in FIGS. 13, 15, and 18, the previously described relatively wider channel 706 is now axially aligned with the projection members 526. Thus, the release pin 520 is enabled to move in the axial direction out of the aperture 534 in the rotatable portion 530 of the release mechanism 124.

In addition, it should be appreciated that when the user lets go of the knob 126 after the knob being rotated to the position shown in FIGS. 13-15, a tension spring 708 in operative connection between the base 128 and the shaft 702 is operative to automatically rotate the shaft 702 and knob 126 to the position shown in FIGS. 10-12. When the knob and shaft are in the position shown in FIGS. 10-12, the previously described compression spring 704 is operative to urge the shaft and knob to move from the axially inward retracted position back to the axially extended position.

Also, when the knob has returned to the position shown in FIGS. 10-12, the torsion spring 1606 (shown in FIG. 18) is operative to rotate the rotatable portion 530 back to the angular orientation shown in FIGS. 7, 9, 10, 12, and 16. Thus, when a user is done operating the release mechanism in the manner described, the release mechanism is operative to re-configure itself back to the neutral orientation shown in FIGS. 7-9.

Figure 19:
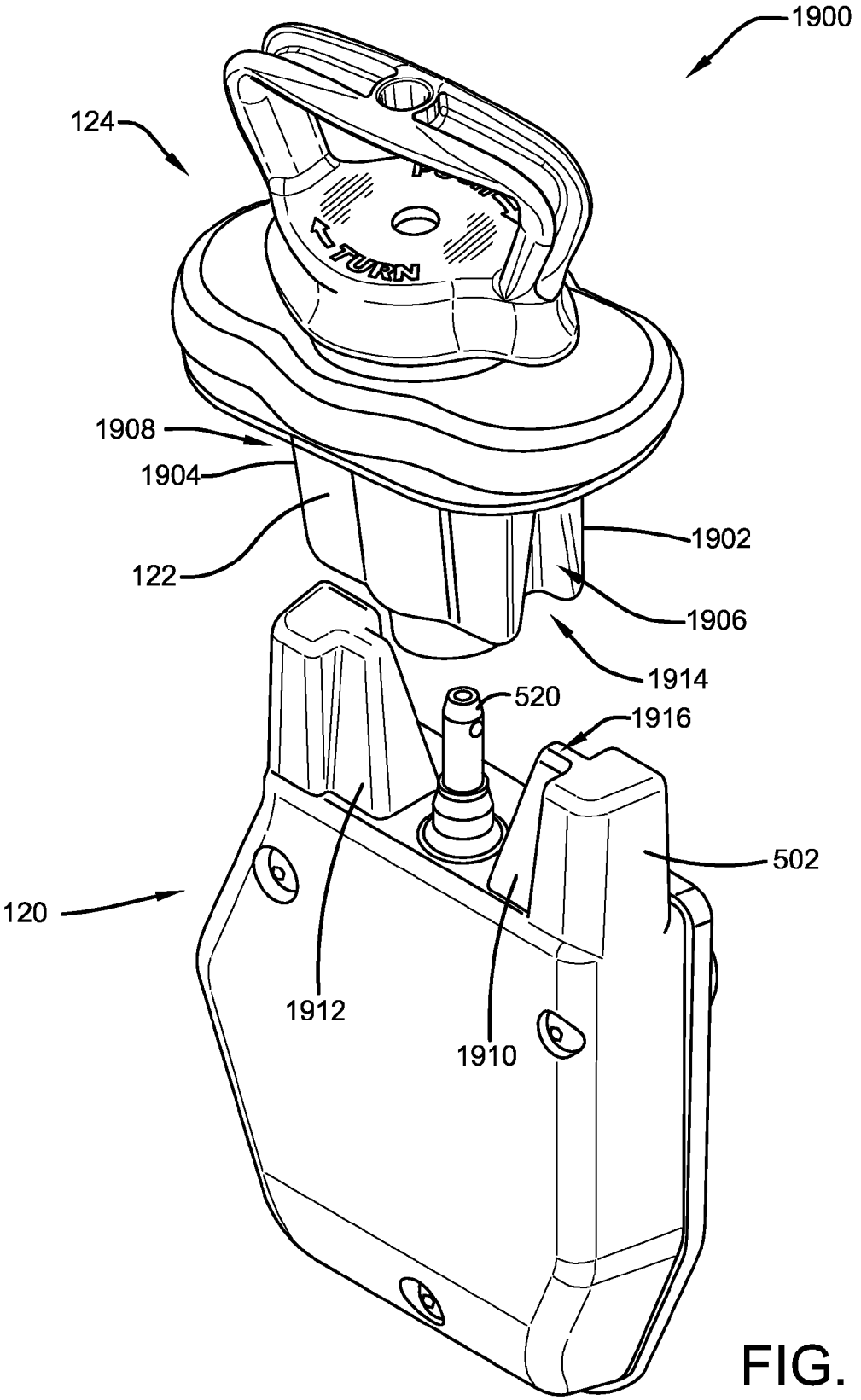
FIGS. 19 and 20 are top, front, and side perspective views of the release mechanism and the latch mechanism disengaged and in engaged latched relation.
Figure 20:
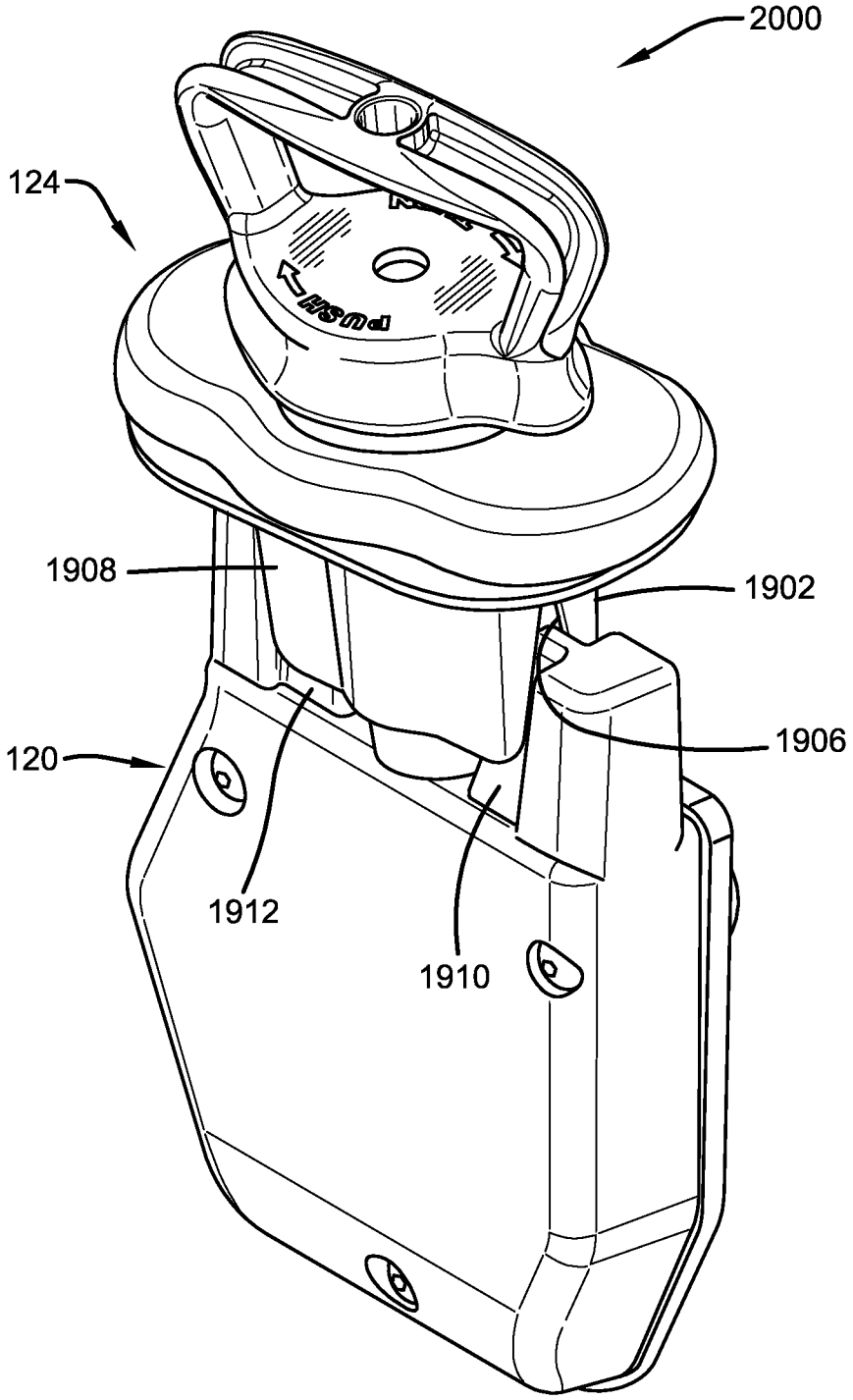

FIG. 19 shows a perspective view 1900 of the exemplary release mechanism 124 that is disengaged from the exemplary latch 120. FIG. 20 shows a perspective view 1800 of the release mechanism 124 that is engaged with the latch 120. In order to facilitate alignment of the release mechanism 124 with the latch, each of two opposed side walls 1902, 1904 of the release pin receptacle 122 includes guide channels 1906, 1908. In this described example, the latch housing 502 may include guide flanges 1910, 1912 spaced apart from the release pin 520 on opposed sides of the release pin. The guide channels 1906, 1908 are operative to receive the guide flanges 1910, 1912 of the latch housing 502 therein when the latch mechanism 120 engages with the release mechanism 124.

As illustrated in FIGS. 19 and 20, the exemplary guide channels 1906, 1908 have a tapered shape with a wider portion 1914 positioned closest to the latch 120. Also, the guide flanges 1910, 1912 have a corresponding tapered shape with a narrower tip portion 1916 positioned closest to the release mechanism. As illustrated in FIG. 20, such an arrangement enables the release mechanism 124 to self-align with the latch 120 when the release mechanism and the latch mechanism are not initially aligned with each other as they move together toward latched engagement. It should also be noted that alternative example embodiments may have other arrangements of tapered surfaces including curved surfaces, other configurations of tapered surfaces, or another arrangement of cooperating surfaces on the release mechanism and latch mechanism that enable these elements to be self-aligned when brought together.

As discussed previously, animals such as raccoons are exceptionally clever at figuring out ways to open waste containers and may be capable of knocking a waste container on its back side. In such circumstances, in order to further minimize the opportunity for the described release weight of the latch mechanism from sliding a sufficient distance to cause the latch to be disengaged from the release mechanism, an example embodiment may include an internal weight stopper that limits sliding of the release weight at only certain angular orientations of the latch mechanism.

Figure 21:
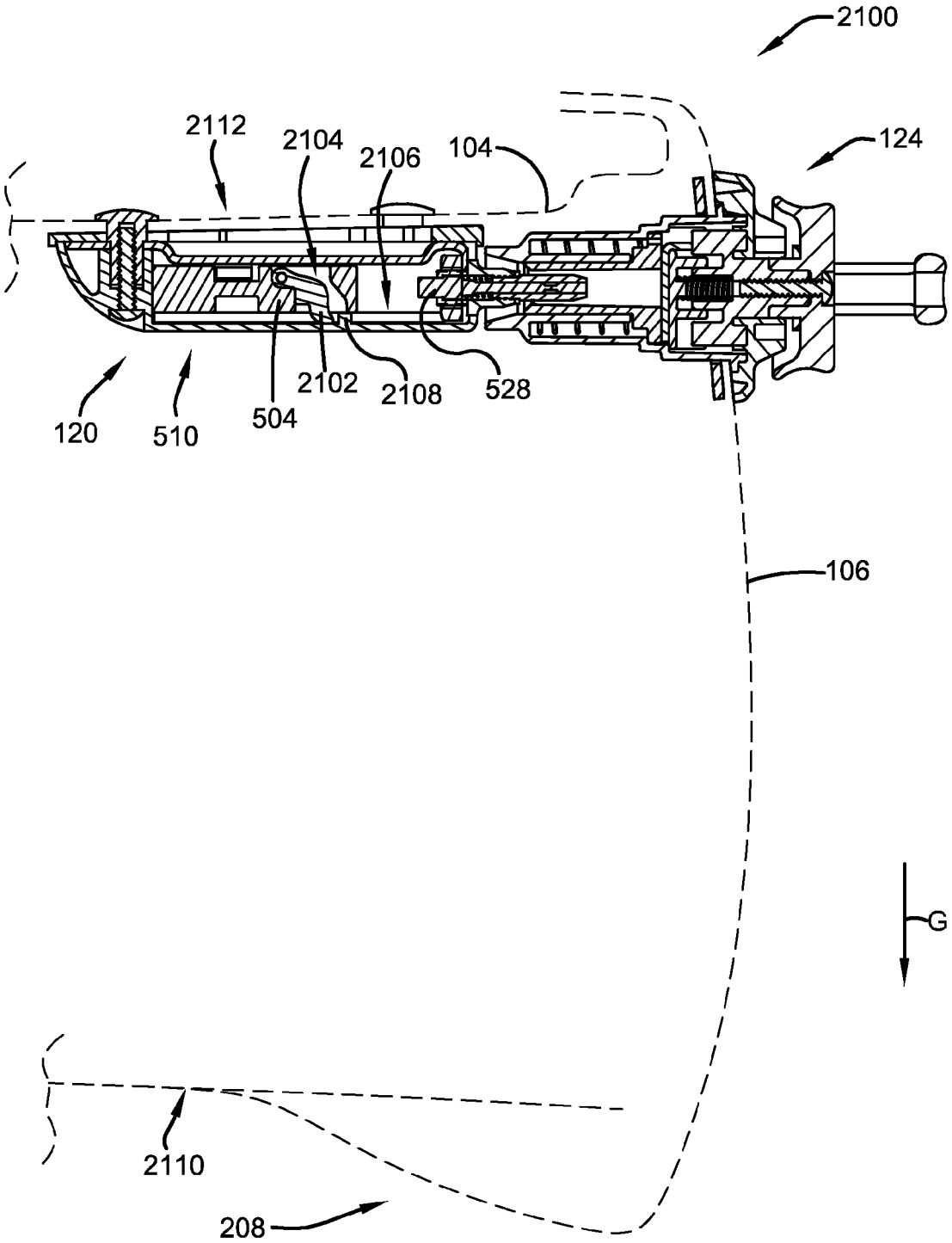
FIGS. 21-22 are side cross-sectional views of the release mechanism and latch mechanism at different angular orientations.
Figure 22:
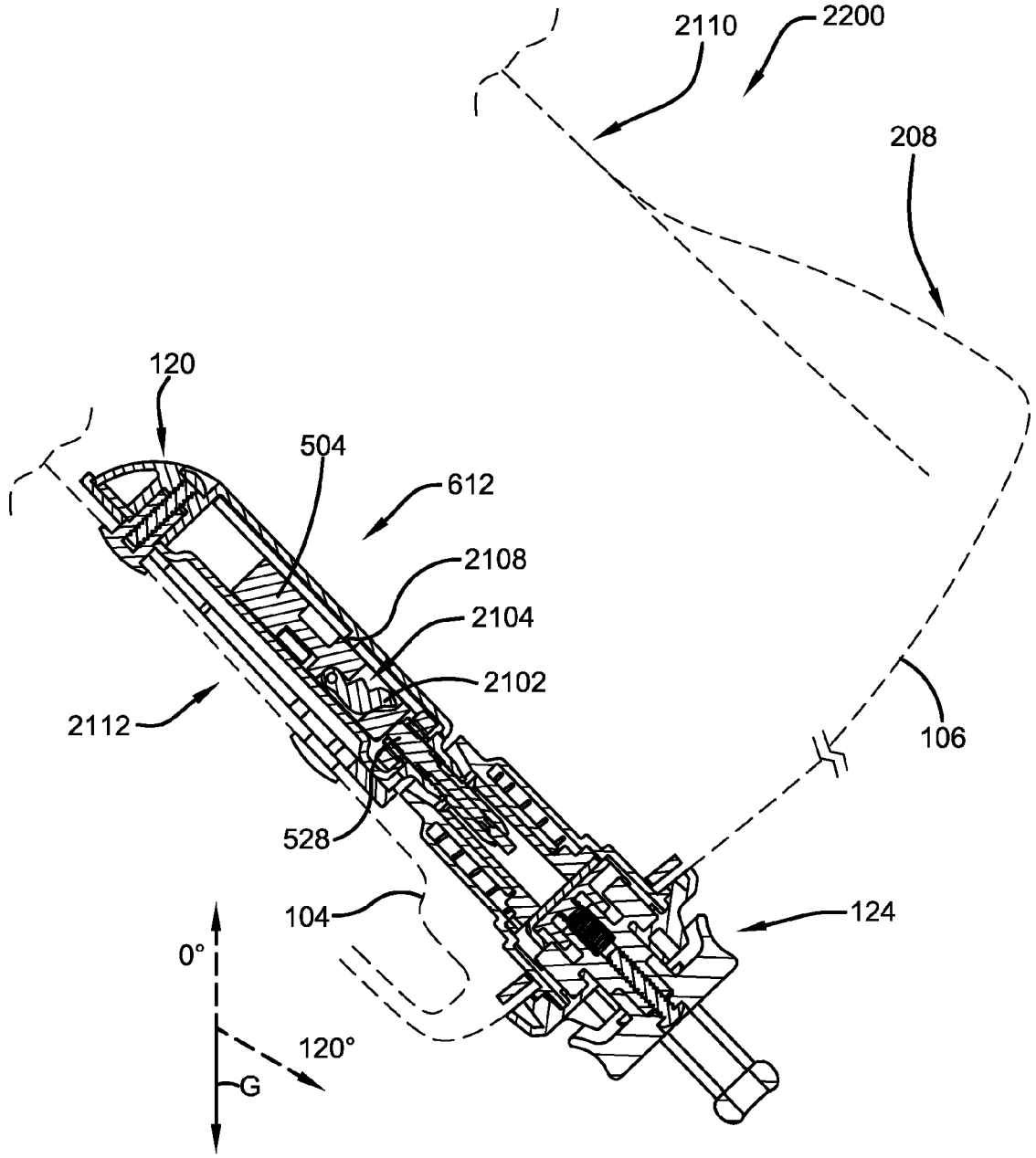

FIGS. 21 and 22 show side cross-sectional views 2100, 2200 of the latch mechanism 120 to illustrate an example embodiment of such a weight stopper 2102. In this example, the release weight 504 includes a cavity 2104 configured to house the weight stopper and enable the weight stopper to pivot with respect to the release weight.

FIG. 21 shows the latch mechanism 120 as it would be positioned in the waste container 104 that is rotated −90 degrees from an upright position to lay on its back side 2110, where the back side corresponds to the side of the waste container having the lid hinge portions 208 closest thereto. Also in this orientation, a front facing side 2112 of the waste container (where the latch mechanism is mounted) faces upwardly. In contrast, FIG. 22 shows the latch mechanism 120 as it would be positioned in a waste container 104 that is rotated with its lid 106 and front side 1212 facing downwardly (e.g., the waste container is rotated to the dump angular orientation such as +120 degrees from an upright position) such as shown in FIG. 4. As can be appreciated, because the exemplary embodiment of the waste container is configured to be automatically lifted and dumped by a lifting mechanism, the orientation of the waste container as it is lifted is consistent with the hinge being disposed further upwardly than the latch as the container is moved into the dump angular orientation. This results due to the configuration of the container, including the ability of the lifting mechanism, to engage the retention bar 210 on the container for purposes of lifting the container. Further, in the exemplary arrangement with the hinge located further upwardly from the latch, the lid is enabled to open and not impede the dumping of the contents of the cavity within the waste container to the extent that would occur if the hinged side of the lid were positioned downwardly relative to the container.

As shown in FIG. 21, the exemplary latch housing includes an inner side wall 2106. The release weight is configured to slide along the inner side wall between the previously described first and second positions 510, 612. This inner side wall 2106 may include a housing ridge 2108 adjacent the release weight that is positioned to catch and engage the weight stopper 2102. For example, when the waste container 104 is orientated on its backside 1210 (as shown in FIG. 21), the weight stopper is operatively configured to be responsive to gravity G to rotate about a pivot and downward to extend outwardly from the release weight 504 so that an outward tip of the weight stopper engages a side of the housing ridge 2108. This arrangement of the weight stopper (in engagement with the housing ridge), is operative to prevent the release weight from sliding forward to contact the release pin button 528 and causing the latch mechanism 120 to disengage from the release mechanism 124.

However, when the waste container 104 is orientated in the dump angular orientation, such as +120 degrees from an upright position, and with the hinge for the lid relatively above the latch (as shown in FIG. 22), the weight stopper is operatively configured to be responsive to gravity G to rotate away from the housing ridge to a retracted position in the cavity 2140 of the release weight 504. In this configuration, the tip of the weight stopper 2102 does not engage the side of the housing ridge 2108. With the weight stopper in this orientation, the release weight is enabled to slide forward responsive to gravity G to contact the release pin button 528, which causes the latch mechanism 120 to be enabled to disengage from the release mechanism 124.

With reference to FIG. 1, it should be appreciated that the exemplary described apparatus includes a latch 120 with a gravity controlled release mechanism as well as an outside knob controlled release mechanism 124. However, it should be appreciated that alternative embodiments may include other forms of release mechanisms in combination with the release mechanisms described previously.

Figure 23:
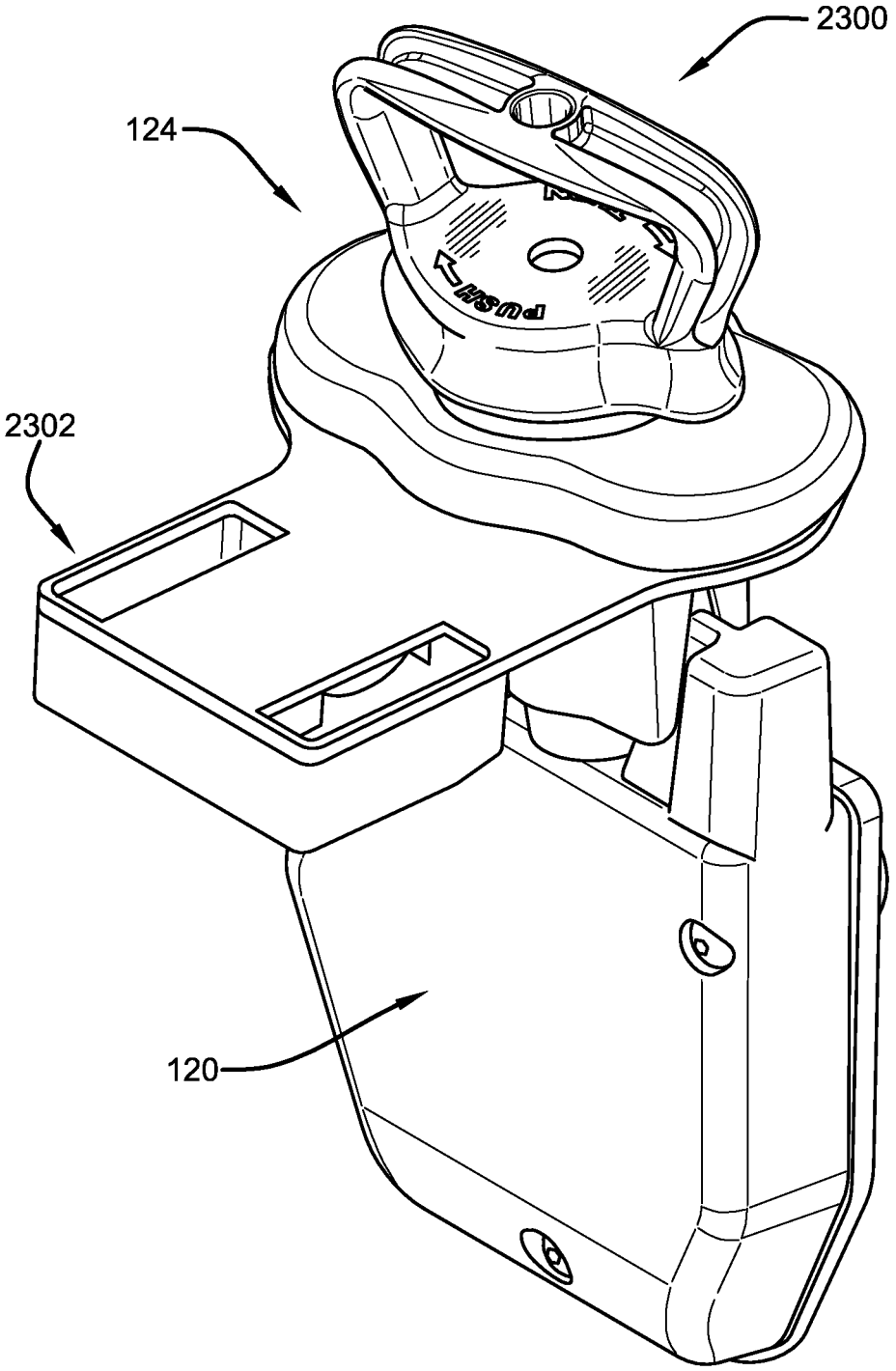
FIG. 23 is a top, left side perspective view of an alternative exemplary embodiment having both an outside and an inside release mechanism.

For example, FIG. 23 is a perspective view of an alternative example embodiment 230 that includes both the previously described latch 120 and the previously described outside release mechanism 124 as well as an inside release mechanism 2302. Such an inside release mechanism may be positioned on the inside of the lid of the waste container.

Figure 24:
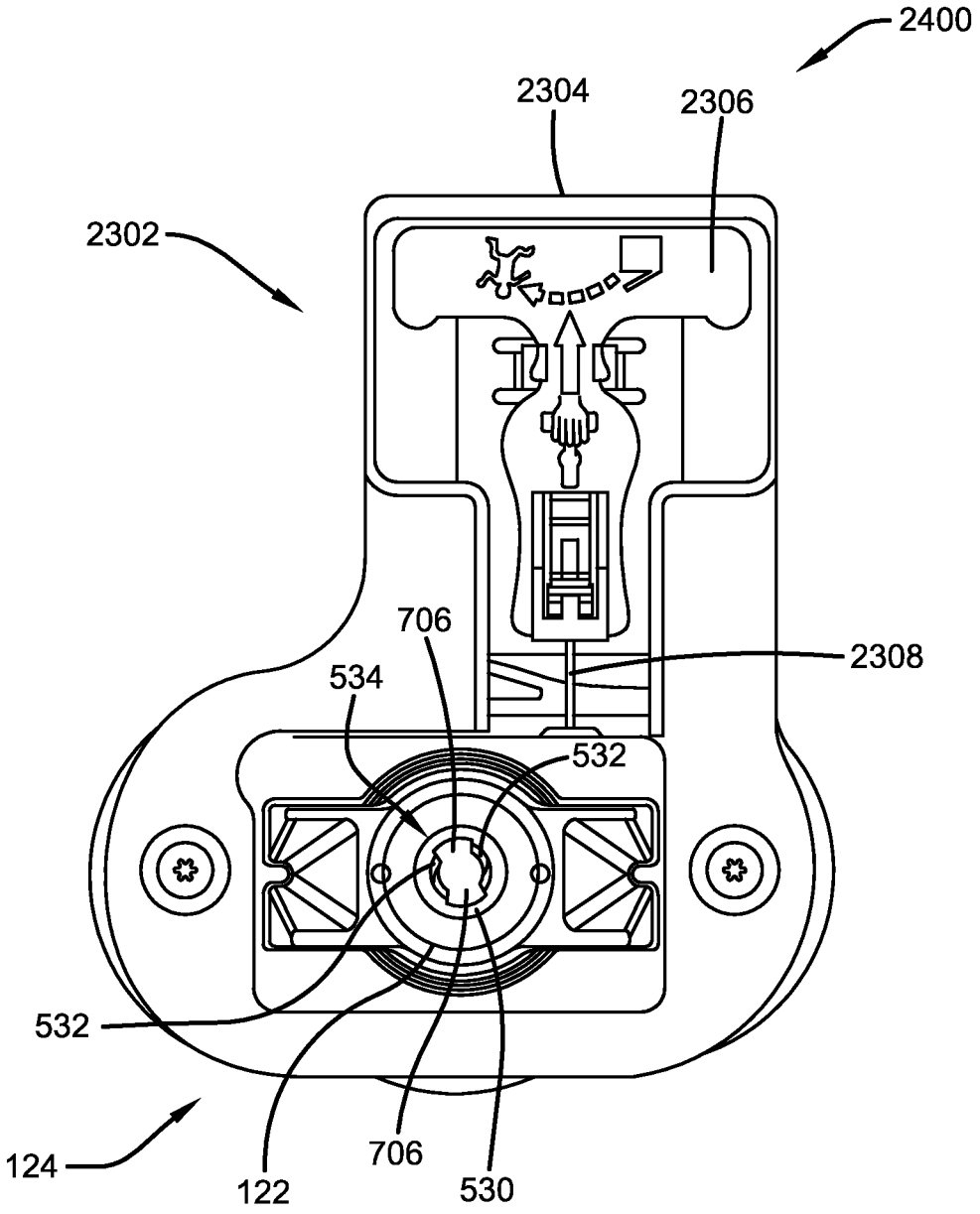
FIG. 24 is a bottom view of the alternative embodiment.

To illustrate the exemplary inside release mechanism more clearly, FIG. 24 shows a bottom view 2400 of the combination of the outside release mechanism 124 and the inside release mechanism 2302 with the latch mechanism removed. In this example, the inside release mechanism 2302 may include a handle holder 2304 that is operative to releasably hold a handle 2306. The handle may include a flexible linkage 2308 (such as a cable or rope) that extends into operative connection with the previously described rotatable portion 530 of the release pin receptacle 122. In exemplary arrangements, the release handle may include markings, such as fluorescent markings or similar markings to enable it to be visible in the dark, such as from the inside of the closed container.

Figure 25:
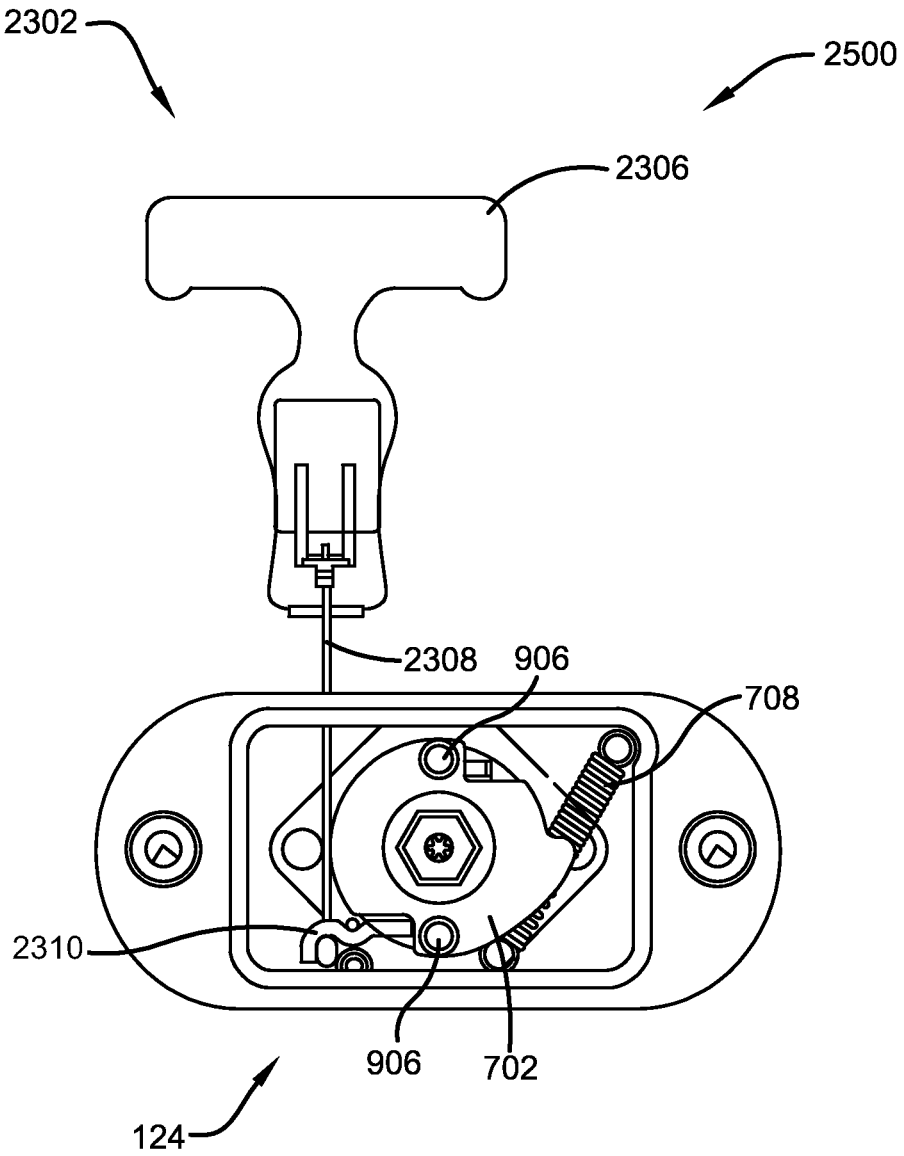
FIGS. 25 and 26 are top internal views of portions of the alternative embodiment showing operation of a pull handle.
Figure 26:
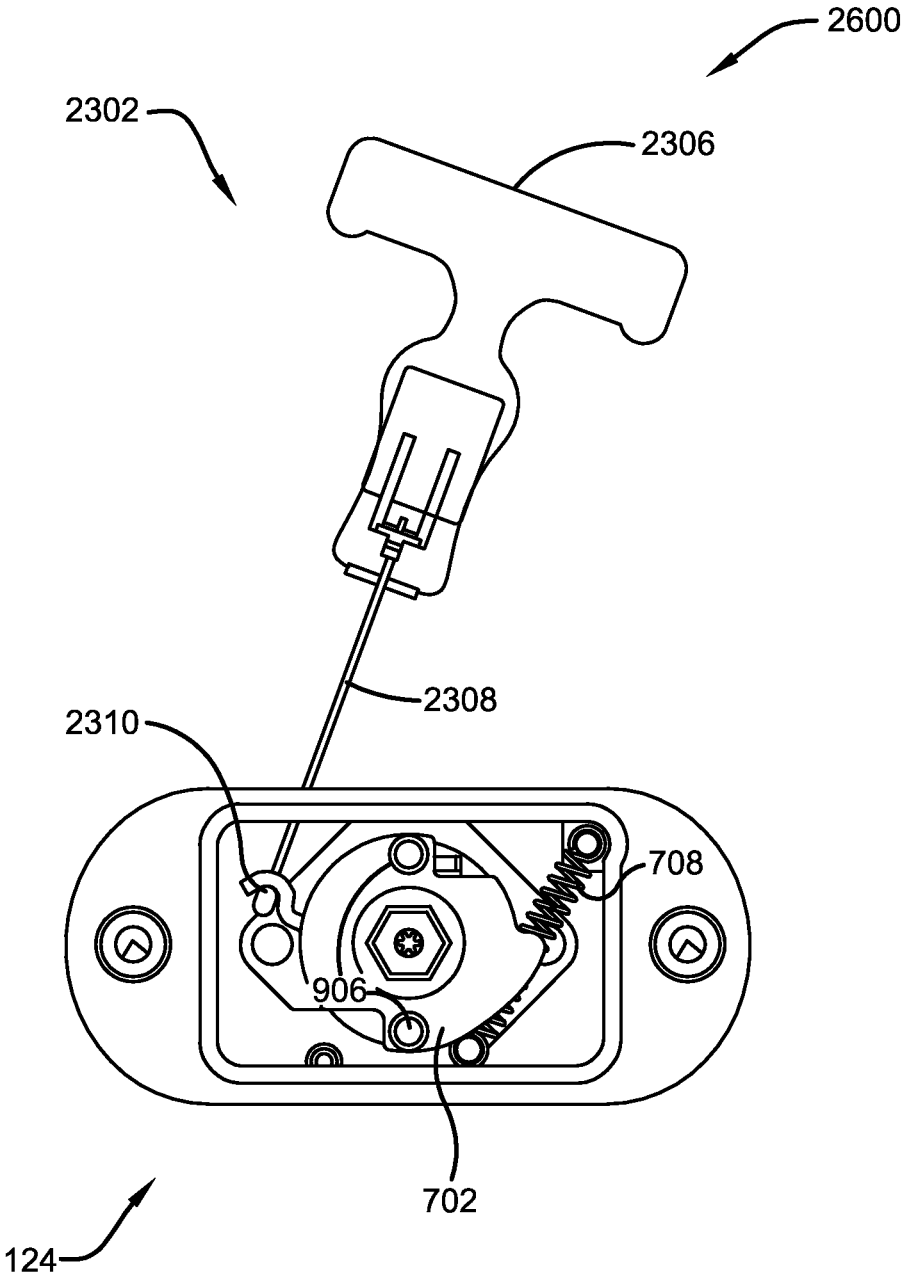

To further illustrate the connection of the flexible linkage 2308, FIGS. 25 and 26 show top views 2500, 2600 of the outside release mechanism 124 and the inside release mechanism 2302 with the previously described knob, base and handle holder being removed. FIG. 25 shows the outside and inside release mechanisms in a neutral configuration that is operative to maintain engagement with the previously described latch mechanism. Here, the flexible linkage 2308 is in operative connection with an arm 2310 that extends from the rotatable portion (which is positioned under the shaft 702).

FIG. 26 shows the handle being pulled outwardly or otherwise away from the release mechanism, which causes the arm 2310 and connected rotatable portion to rotate (from a first angular position to a second angular position) so as to align the previously described relatively wider channels 706 (shown in FIG. 24) with the radially extending projection members (not shown) of a release pin. As a result, a release pin is enabled to slide out of engagement with the release pin receptacle 122 and the lid to be opened.

Also, with respect to FIG. 24, it should be appreciated that the handle holder 2304 is operative to hold the handle 2306 in a position such that the flexible linkage 2308 does not urge the rotatable portion 530 to rotate from the first angular position to the second angular position. This may be done for example in exemplary embodiments by including flexible plastic pins or walls with engaging recesses that are configured to hold the handle in the recessed position. Such flexible holding members are operative to hold the handle in a recessed relation relative to the housing until it is manually grasped in a way which deforms the plastic pins or walls and enables the handle to be movable in the manner that has been described.

In addition, it should be noted with respect to FIGS. 24, 25 and 26, that the rotatable portion 530 and arm 2310 are operative to rotate independently from the first angular position (shown in FIG. 24) to the second angular position (shown in FIG. 25) without causing the shaft (to which the knob is connected) to rotate. Thus, the inside release mechanism is operative to disengage the latch mechanism from the release pin receptacle without any need to push and turn the knob as previously described.

Further, it should be understood while the exemplary configuration of the release handle is a T-shaped handle, other embodiments may include other types of handle configurations. Such handle configurations may include for example a cylindrical handle configuration or a round handle configuration that is suitable for being displaced and pulled in order to enable the latch change from a latched condition to an unlatched condition. Further, in other exemplary arrangements the handle may include a configuration that is in connection with a spring or other biasing mechanism that biases a flexible member or other member to rotate the receptacle to an unlatched position. Thus, in exemplary arrangements the act of moving or breaking an item which acts against the biasing force automatically changes the latch to an unlatched condition. In some exemplary configurations, such an approach of merely displacing a component from its normal position rather than having to displace and pull the component may make it easier to change the condition of the latch. Of course it should be understood that these approaches are exemplary and in other embodiments other approaches may be used.

In example embodiments, the described components of the latch mechanism, release mechanism, and striker/release button mechanism may be comprised of plastics (e.g., Polycarbonate, ABS, PVC), metals (stainless steel, aluminum, tin), and/or any other materials that are operative to form the shapes and be capable of carrying out the functions described herein. Further, these described elements may be mounted together with fasteners such as screws, bolts, adhesives, or any other fastening or bonding system applicable to the type of materials being assembled. In addition, it should be appreciated that the housings may include gaskets, o-rings, and/or other elements to increase the weather/water resistance of the described mechanisms.

It is noted that several examples have been provided for purposes of explanation. These examples are not to be construed as limiting the hereto-appended claims. Additionally, it may be recognized that the examples provided herein may be changed or permutated while still falling under the scope of the claims.

Further, it should be appreciated that while the exemplary embodiments described herein relate to waste containers and particular configurations of the exemplary waste containers, the structures and principles of the exemplary embodiments may be applied to other configurations of waste containers or other types of containment devices, closure structures or latching arrangements in other fields of use.

Thus the exemplary embodiments described herein achieve improved operation, eliminate difficulties encountered in the use of prior devices, systems and methods and attain the useful results described herein.

In the foregoing description certain terms have been used for brevity, clarity and understanding. However, no unnecessary limitations are to be implied therefrom because such terms are used for descriptive purposes and are intended to be broadly construed. Moreover, the descriptions and illustrations herein are by way of examples and the inventive aspects are not limited to the features shown and described.

Having described the features, discoveries and principles of the exemplary embodiments, the manner in which they are constructed and operated and the advantages and useful results attained, the new and useful structures, devices, elements, arrangements, parts, combinations, systems, equipment, operations, methods, processes and relationships are set forth in the appended claims.

We claim:

1. Apparatus comprising:

a release mechanism configured for operatively attached engagement with a waste container; and a latch configured for operatively attached engagement with the waste container, wherein the latch includes a latch housing, an engagement portion, a release weight, and a rotary damper, wherein the engagement portion is operative to hold the release mechanism in engagement with the engagement portion, wherein the release weight is configured to move linearly along a straight path in the latch housing responsive to gravity and a first change in latch orientation, from a first position wherein the weight is not in operative actuating engagement with the engagement portion, to a second position wherein the weight is in actuating engagement with the engagement portion and causes the engagement portion to change from a first configuration wherein the engagement portion holds the release mechanism in engagement with the engagement portion, to a second configuration in which the engagement portion and the release mechanism are enabled to disengage, wherein the release weight is operative to move in the latch housing responsive to gravity and a second change in latch orientation from the second position to the first position, wherein movement of the weight away from the second position is operative to cause the engagement portion to change from the second configuration to the first configuration, wherein the rotary damper is in operative connection with the release weight, wherein the release weight is operative to slow movement of the release weight from the first position to the second position.

2. The apparatus according to claim 1, wherein when the release weight is in the first position, the release weight is spaced away from the engagement mechanism, wherein the rotary damper is operative to slow movement of the release weight in the housing such that an amount of time for the release weight to move responsive to gravity from the first position to the second position is at least twice an amount of time the release weight would take to move responsive to gravity from the first position to the second position in the housing absent the effect of the rotary damper on the release weight.

3. The apparatus according to claim 2, wherein the engagement portion includes:

a release pin, wherein the release pin includes an outer wall and an axial cavity therein, a plurality of projection members, wherein the projection members are configured to move in operatively supported connection with the release pin between radially retracted positions and extended positions with respect to the outer wall of the release pin;

a release pin button, wherein the release pin button is relatively movable axially relative to the release pin, and wherein a portion of the release pin button extends in the axial cavity in the release pin, wherein responsive to release weight movement to the second position of the release weight, the release weight operatively engages and causes the release pin button to move from a first position to a second position in the cavity in the release pin, wherein in the second position of the release pin button, the projection members are enabled to move from extended positions to the retracted positions; and a spring, wherein the spring is in operative connection with the release pin button, wherein responsive to release weight movement from the second position so as to not be in operative engagement with the release pin button, the spring is operative to urge the release pin button to move from the second position to the first position of the release pin button, wherein such movement is operative to cause the projection members to move to the extended positions.

4. The apparatus according to claim 3, wherein the release mechanism includes a release base and a release knob, wherein movement of the release knob relative to the release base axially from an outward position to an inward position and then from a first angular orientation to a second angular orientation relative to the release base, is operative to enable the release mechanism to be disengaged from the engagement portion of the latch.

5. The apparatus according to claim 4, wherein the release mechanism includes a release pin receptacle in operative connection with the release base, wherein the release pin receptacle includes a rotatable portion that is enabled to rotate between a first angular position and a second angular position, wherein the rotatable portion includes an aperture that is configured to receive the release pin therein, wherein in the first angular position of the rotatable portion, the rotatable portion is operative to hold the release pin in engagement with the rotatable portion when the projection members are in the extended positions and the knob is in the axially outward position.

6. The apparatus according to claim 5, wherein movement of the release knob relative to the release base axially from the outward position to the inward position, and then from a first angular orientation to a second angular orientation of the knob relative to the release base, is operative to cause the rotatable portion to move to the second angular orientation of the rotatable portion, wherein the release pin and release mechanism are enabled to disengage while the projection members remain in the extended position.

7. The apparatus according to claim 6, wherein the aperture of the rotatable portion includes at least one angled inner ridge, wherein inward release pin movement in the aperture causes at least one of the projection members in the extended position to contact the at least one inner ridge and cause the rotatable portion to rotate from the first angular position towards the second angular position, wherein the rotatable portion is configured such that when the release pin extends inwardly a distance into the aperture where the projection members are past the at least one ridge, the rotatable portion is operative to automatically rotate back to the first angular position, wherein when the rotatable portion is in the first angular position and the release knob is in the outward position of the release knob, the at least one inner ridge is operative to engage the projection members in the extended positions and prevent the projection members from moving outwardly from the aperture so as to disengage the rotatable portion.

8. The apparatus according to claim 7, wherein movement of the rotatable portion to the second angular position responsive to the knob, the inner ridges move to positions that enable the projection members in the extended positions to move outwardly in the aperture past the inner ridges and enable the release pin and release pin receptacle to disengage from each other.

9. The apparatus according to claim 8, wherein the rotatable portion is enabled to rotate from the first angular position to the second angular position of the rotatable portion, without movement of the knob.

10. The apparatus according to claim 9, and further comprising:

an aperture and a projection, wherein the aperture is configured to engage the projection, wherein the knob is in operative connection with one of the aperture and the projection, and the release base is in operative connection with the other of the aperture and the projection, wherein when the knob is in the outward position relative to the release base, the aperture is in engagement with the projection, which engagement is operative to prevent the knob from being rotated in a manner which causes the rotatable portion to rotate.

11. The apparatus according to claim 10, wherein the release mechanism further includes:

a torsion spring, wherein the torsion spring is in operative connection with the rotatable portion and is configured to urge the rotatable portion to rotate from the second angular position to the first angular position of the rotatable portion;

a tension spring, wherein the tension spring is configured to urge the knob to rotate from the second angular orientation to the first angular orientation; and a compression spring that is configured to urge the knob to axially move from the inward position to the outward position.

12. The apparatus according to claim 11, wherein each of two opposed walls of the release pin receptacle include guide channels, wherein the latch housing includes guide flanges spaced apart from the release pin on opposed sides of the release pin, wherein the guide channels are operative to receive the guide flanges of the latch housing therein when the latch is in latched engagement with the release mechanism.

13. The apparatus according to claim 10, and further comprising:

an inside release mechanism including a handle configured to extend inside the waste container, a flexible linkage that extends from the handle into operative connection with the rotatable portion, wherein movement of the handle is operative to cause the rotatable portion to rotate from the first angular position to the second angular position of the rotatable portion.

14. The apparatus according to claim 13, wherein the inside release mechanism includes a handle holder that is operative to hold the handle in releasable engagement with the handle holder in a position such that the flexible linkage does not urge the rotatable portion to rotate from the first angular position toward the second angular position.

15. The apparatus according to claim 5, and further comprising:

the waste container, wherein the waste container includes a bin and a lid, wherein the lid is configured to pivot with respect to the bin between an open position and a closed position, wherein the bin includes a cavity and an opening into the cavity, wherein the bin includes an inside wall surface, wherein the open position of the lid, the cavity of the bin is accessible from outside the waste container, wherein in the closed position of the lid, the lid is operative to cover the opening to the cavity, wherein when the lid is in the closed position the lid includes an inside surface facing the interior of the cavity of the bin and the lid includes an opposed outside surface, wherein the latch is in operative connection with the inside wall surface of the bin, wherein the release mechanism is in operative connection with the lid such that the release knob is positioned adjacent the outside surface of the lid and the release pin receptacle is positioned adjacent the inside surface of the lid, wherein when the lid is in the closed position, the release mechanism is operative to hold the latch in engagement with the release mechanism.

16. The apparatus according to claim 2, wherein the release weight includes a channel, wherein the rotary damper includes a rotatable shaft and a lever that extends from the rotatable shaft into operative engagement with at least one wall bounding the channel of the release weight, wherein the at least one wall of the channel has a shape that causes the lever to pivot and rotate the rotatable shaft from a first angular orientation to a second angular orientation when the release weight moves from the first position to the second position, and that causes the lever to pivot and rotate the rotatable shaft from the second angular orientation to the first angular orientation when the release weight moves from the second position to the first position, wherein the rotation of the rotatable shaft from the first angular position to the second angular position causes the rotary damper to exert a first force on the release weight that slows movement of the release weight from the first position to the second position.

17. The apparatus according to claim 16, wherein the rotation of the rotatable shaft from the second angular position to the first angular position causes the rotary damper to exert a second force on the release weight that slows movement of the release weight from the second position to the first position, wherein the first force is greater than the second force.

18. The apparatus according to claim 17, wherein the at least one wall bounding the channel is configured such that the first and second forces are in alignment with the linear straight path along which the release weight moves between the first and second positions.

19. The apparatus according to claim 11, wherein the latch housing includes a housing ridge adjacent the release weight, wherein the latch includes a weight stopper in operative pivoting connection with the release weight, wherein in a first set of angular orientations of the latch mechanism, the weight stopper is operative responsive to gravity to move relative to the release weight so as to operatively engage the housing ridge and prevent the release weight from sliding to the second position, wherein a second set of angular orientations of the latch mechanism, the weight stopper is operative to be disposed from the housing ridge and enable the release weight to move to the second position.

20. Apparatus comprising:

A latch, wherein the latch is configured for operatively attached engagement with a waste container, wherein the latch includes a housing, a weight, wherein the weight is linearly movable along a straight path within the housing, a projection member, wherein the projection member is movably mounted in operatively supported connection with the latch, wherein the projection member is in operative connection with the weight, and wherein the projection member is configured for releasable engagement with a ridge of an engagement member that is movable relative to the latch, a damper, wherein the damper extends in the housing and is in operative connection with the weight, wherein movement of the latch to a dump angular orientation corresponding to the waste container in a dump position, is operative to cause the weight to move along the path in the housing at a controlled speed responsive to the damper, wherein such movement of the weight is operative to cause the projection member to move to disengage from the ridge, whereby the waste container is enabled to open to have the contents dumped therefrom.

21. The apparatus according to claim 20, and further comprising:

the engagement member, wherein the engagement member includes a rotatable portion, wherein the rotatable portion includes an aperture, wherein the aperture is configured to accept the projection member therein, and wherein the aperture includes a radially inward angled ridge therein, wherein the projection member is configured to engage the ridge responsive to relatively inward movement of the projection member in the aperture, to cause the rotatable portion to rotate so as to cause the ridge and the projection member to be engaged in holding engagement.

22. The apparatus according to claim 21, wherein movement of the weight responsive to the latch being in the dump angular orientation is operative to cause the projection member in latched engagement with the ridge and the aperture to move radially inwardly relative to the aperture, wherein the projection member and the ridge are enabled to disengage.

23. The apparatus according to claim 21, and further comprising:

at least one manually movable member, wherein the at least one manually movable member is in operative connection with the rotatable portion, wherein movement of the at least one manually movable member is operative to cause the rotatable portion to rotate so as to enable the projection member and the ridge to disengage.

24. The apparatus according to claim 23, wherein the at least one manually movable member comprising a knob, wherein the knob is configured to be manually movably accessible from outside the waste container.

25. The apparatus according claim 23, wherein the at least one manually movable member includes a handle, wherein the handle is configured to be accessible from inside of the waste container.

* * * * *